US007627280B2

(12) United States Patent
Sato

(10) Patent No.: US 7,627,280 B2
(45) Date of Patent: Dec. 1, 2009

(54) DEVELOPER TRANSPORTING APPARATUS, IMAGE FORMING APPARATUS, AND IMAGE FORMING METHOD

(75) Inventor: Tomonori Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 247 days.

(21) Appl. No.: 11/808,073

(22) Filed: Jun. 6, 2007

(65) Prior Publication Data

US 2008/0118290 A1 May 22, 2008

(30) Foreign Application Priority Data

Nov. 21, 2006 (JP) ..... P2006-314494

(51) Int. Cl.
*G03G 21/12* (2006.01)
*G03G 21/10* (2006.01)

(52) U.S. Cl. ..... 399/360; 399/358

(58) Field of Classification Search ..... 399/98, 399/99, 119, 120, 254, 256, 261, 263, 358–360
See application file for complete search history.

(56) References Cited

U.S. PATENT DOCUMENTS 5,950,062 A * 9/1999 Yahata et al. ..... 399/358
6,055,405 A * 4/2000 Knott et al. ..... 399/358
6,085,062 A * 7/2000 Mizuishi et al. ..... 399/358
6,266,511 B1 * 7/2001 Murakami et al. ..... 399/358
2005/0002708 A1 * 1/2005 Jeong et al. ..... 399/358

FOREIGN PATENT DOCUMENTS

JP 2000-284594 10/2000
JP 2000-284660 10/2000
JP 2003-255792 9/2003

* cited by examiner

*Primary Examiner*—David M Gray
*Assistant Examiner*—Gregory H Curran
(74) *Attorney, Agent, or Firm*—Morgan, Lewis & Bockius LLP

(57) ABSTRACT

A developer transporting apparatus includes: a drop path; a developer transporting path; a developer transporting member; and an aggregation preventing member including: a contact portion that is in contact with the developer transporting member, and that moves in conjunction with the rotation of the developer transporting member; and a developer scrub-off portion that is disposed between an inner wall surface of the developer transporting path and the developer transporting member, and that moves along the inner wall surface in conjunction with the movement of the contact portion, at least part of the aggregation preventing member being disposed at a connecting portion between the drop path and the developer transporting path to prevent the aggregation of the developer to the inner wall surface.

10 Claims, 16 Drawing Sheets

DEVELOPER TRANSPORTING APPARATUS, IMAGE FORMING APPARATUS, AND IMAGE FORMING METHOD

CROSS-REFERENCE TO RELATED APPLICATIONS

This application is based on and claims priority under 35 U.S.C. 119 from Japanese Patent Application No. 2006-314494 filed Nov. 21, 2006.

BACKGROUND

1. Technical Field

The present invention relates to a developer transporting apparatus, an image forming apparatus, and an image forming method.

2. Related Art

Conventionally, for example, in an image forming apparatus of electrophotographic type commonly used in photocopiers, printers and the like, a developer transporting apparatus is provided for transporting a supply developer and a recovered waste developer.

SUMMARY

According to a first aspect of the present invention, a developer transporting apparatus comprising: a drop path through which a developer drops; a developer transporting path that is connected to the drop path, and through which a developer flowing thereinto from the drop path is transported; a developer transporting member that is disposed within the developer transporting path, and that rotates to transport the developer residing within the developer transporting path; and an aggregation preventing member including: a contact portion that is in contact with the developer transporting member, and that moves in conjunction with the rotation of the developer transporting member; and a developer scrub-off portion that is disposed between an inner wall surface of the developer transporting path and the developer transporting member, and that moves along the inner wall surface in conjunction with the movement of the contact portion, at least part of the aggregation preventing member being disposed at a connecting portion between the drop path and the developer transporting path to prevent the aggregation of the developer to the inner wall surface.

BRIEF DESCRIPTION OF THE DRAWINGS

Exemplary embodiment of the present invention will be described in detail based on the following figures, wherein:

FIGS. 10A to 10F are drawings which describe the function of Embodiment 1, in which FIG. 10A is an explanatory drawing which describes an initial state of a conventional waste developer transporting apparatus, FIG. 10B is an explanatory drawing which describes a state in which a developer starts sticking to an inner wall surface from the state shown in FIG. 10A, FIG. 10C is an explanatory drawing which shows a state in which the developer that has continued to stick from the state shown in FIG. 10B is now growing into aggregates, FIG. 10D is an explanatory drawing which shows a state in which the aggregates of developer have grown further from the state shown in FIG. 10C, FIG. 10E is an explanatory drawing which shows a state in which the aggregates of developer have grown further from the state shown in FIG. 10D to clog the drop path, and FIG. 10F is an explanatory drawing of the waste developer transporting apparatus 1 of Embodiment 1;

FIGS. 12A and 12B are explanatory drawings of an aggregation preventing member of Embodiment 3 of the invention, in which FIG. 12A is an explanatory perspective view of the aggregation preventing member which corresponds to FIG. 9 illustrating Embodiment 1, and FIG. 12B is a sectional view of a main part of the aggregation preventing member which corresponds to FIG. 5 illustrating Embodiment 1;

FIGS. 13A and 13B are explanatory drawings of an aggregation preventing member of Embodiment 4 of the invention, in which FIG. 13A is an explanatory perspective view of the aggregation preventing member which corresponds to FIG. 9 illustrating Embodiment 1, and FIG. 13B is a sectional view of a main part of the aggregation preventing member which corresponds to FIG. 5 illustrating Embodiment 1;

FIGS. 15A and 15B are explanatory drawings of an aggregation preventing member of Embodiment 5 of the invention, in which FIG. 15A is an explanatory perspective view of the aggregation preventing member which corresponds to FIG. 9 illustrating Embodiment 1, and FIG. 15B is a sectional view of a main part of the aggregation preventing member which corresponds to FIG. 5 illustrating Embodiment 1.

DETAILED DESCRIPTION

Figure 1:
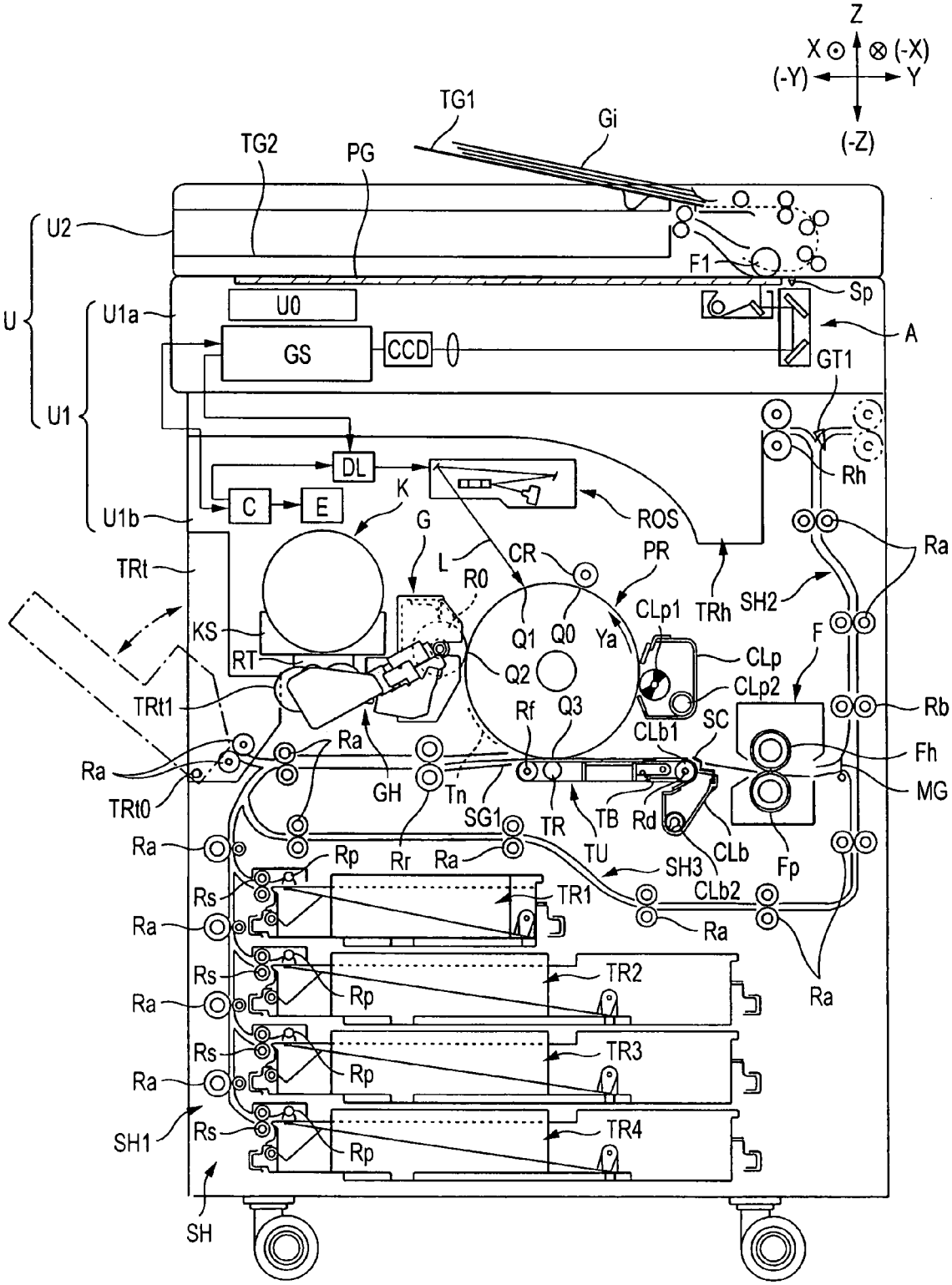
FIG. 1 is an explanatory drawing of an image forming apparatus which includes a developer transporting apparatus of Embodiment 1 of the invention.

Next, referring to the drawings, specific examples of a mode for carrying out the invention (hereinafter, referred to as embodiments) will be described, but the invention is not limited to embodiments to be described below.

Note that for the purpose of easy understanding of the following description, in the drawings, a longitudinal or back and forth direction is regarded as an X axis direction, a lateral or left and right direction as a Y axis direction and a vertical or up and down direction as a Z axis direction, and directions or sides indicated by arrows X, −X, Y, −Y, Z and −Z are regarded as front, rear, right, left, up and down, or front side, rear side, right side, left side, upper side and lower side.

In addition, in the drawings, a circle with a dot in it indicates an arrow which passes through a sheet of paper on which the drawing is shown from the rear to front of, and a circle with a cross in it indicates an arrow which passes the sheet of paper on which the drawing is shown from the front to rear thereof.

Note that in the description that will be made below while referring to the drawings, for the purpose of easy understanding, other constituent members than those really required for specific descriptions will be omitted from illustration.

EMBODIMENT 1

FIG. 1 is an explanatory drawing of an image forming apparatus which includes a developer transporting apparatus of Embodiment 1 of the invention.

In FIG. 1, an image forming apparatus U includes a photocopying machine U1 as an image forming apparatus main body which has a transparent platen glass PG on an upper side thereof and an automatic document feeder U2 which is mounted detachably on the platen glass PG.

The automatic document feeder U2 has a document feeding section TG1 in which a plurality of documents Gi to be photocopied are accommodated therein in a stacked fashion to be automatically fed to a photocopying position. The plurality of documents Gi which are accommodated in the document feeding section TG1 are made to be discharged sequentially into a document discharge section TG2 after having passed through a photocopying position on the platen glass PG.

The photocopying machine U1 has an operation instruction input section U0 from which an operator inputs his or her instruction, an image reading section U1*a* and an image recording section U1*b* which are disposed in that order underneath the platen glass PG, and an image processing section GS which is provided in either the image reading section U1*a* or the image recording section U1*b*.

The image reading section, functioning as a document reader, which is disposed underneath the transparent platen glass PG on the upper side of the photocopying machine U1 has a reading position detecting member (a platen register sensor) Sp which is disposed in an image reading position and an exposing optical system A.

The exposing optical system A is controlled by a detection signal of the reading position detecting member Sp with respect to its movement and stopping and normally stops in a base position.

During an automatic document feeding operation in which photocopying is performed using the automatic document feeder U2, the exposing optical system A exposes individual documents Gi which sequentially pass through a photocopying position F1 on the platen glass PG in such a state that the exposing optical system A stops in the base position.

During a stationary document feeding operation in which photocopying is performed while the operator manually places a single document Gi on the platen glass PG at a time, the exposing optical system A moves along an underside of the platen glass PG to expose and scan the document so placed on the platen glass PG.

Reflected light from the document Gi so exposed passes through the exposing optical system A is focused on to a CCD which is a solid state image sensing device. The CCD converts the document reflected light which is focused on to its image sensing surface into an electric signal.

In addition, the image processing section GS converts a read picture signal inputted thereinto from the CCD of the image reading section U1*a* into a digital picture write signal and then outputs the digital picture write signal to a laser drive signal output unit DL of the image forming section U1*b*.

The laser drive signal output unit DL outputs a laser drive signal according to image information inputted thereinto to an exposing unit (an optical write and scan unit or an image write unit).

A photoconductor material coated component or photoconductor drum PR which is disposed below the exposing unit rotates in a direction indicated by an arrow Ya. The surface of the photoconductor drum PR is charged by a charge corotron in a charging area Q0 and is then exposed and scanned by a latent image write light beam (a laser beam) L of the exposing unit in a latent image write position Q1, so as to form a latent image. The surface of the photoconductor drum PR on which the latent image is formed then rotationally moves to pass sequentially over a developing area Q2 and a transfer area Q3.

A developing device G for developing the latent image in the developing area Q2 transports a developer which contains toner and carriers to the developing area Q2 by a developing roll R0 which is an example of a developing member to develop the latent image which passes through the developing area Q2 into a visible image (a toner image). A toner image so developed on the surface of the photoconductor drum PR is then transported to the transfer area Q3.

A developer refill container (cartridge) K for refilling a developer that is consumed by the developing device G is mounted detachable on a cartridge mount member KS. A developer inside the cartridge K is transported while being stirred in a developer storage container RT and is then transported to the developing device G by a developer transporting unit GH which is disposed in the developer storage container RT. Note that the developing device G of Embodiment 1 uses a two-component developer which is made up of toner and carriers, and a developer which contains toner and carriers is refilled into the developing device G from the developer refilling container K, while the developer which is now deteriorated is discharged in a small amount. A developing unit which discharges the deteriorated developer in a small amount while being refilled with a fresh developer is conventionally known as is described in, for example, JP-A-2005-208340, and therefore, a detailed description thereof will be omitted here.

A transfer unit TU, which is disposed in such a manner as to face the photoconductor drum PR in the transfer area Q3, has a transfer belt TB, as an example of a transfer and transporting member, which is supported in such a manner as to be rotated by a belt support member (Rd, Rf) which has a drive roll Rd and a driven roll Rf, a transfer roll TR and a separator claw SC, as an example of a transferring device, a belt cleaner CLb, as an example of a developer recovering device, and the like. The transfer roll TR is a member for transferring a toner image on the surface of the photoconductor drum PR on to a sheet S as an example of a medium, and a transfer voltage which has an opposite polarity to the charged polarity of a developing toner that is used in the developing device G is supplied to the transfer roll TR from a power supply circuit E. The power supply circuit E is controlled by a controller which is an example of a control unit.

Sheets S stored in sheets container trays TR1 to TR4 are transported to the transfer area Q3 by way of a sheet feeding path SH1. Namely, sheets S stored in the individual sheets container trays TR1 to TR4 are picked up at front ends of the sheet container trays by pickup rolls Rp which are an example of a pickup member, separated into individual sheets by separation rolls Rs which are an example of a separation member and are transported to register rolls Rr which are an example of a transfer area transporting member by a plurality of transporting members Ra.

In addition, a manual sheet feeder section TRt, which is an example of a manual sheet feeding member, is placed to the left (in a −Y direction in FIG. 1) of the cartridge mount member KS and the developer storage container RT, and a sheet S fed from the manual sheet feeder section TRt is also transported to the predetermined transfer area Q3. In the image forming apparatus of Embodiment 1, the manual sheet feeder section TRt is supported in such a manner as to rotate about a rotation center TRt0, and in such a state that the manual sheet feeder section TRt is stored in an interior of the image forming apparatus (refer to solid lines in FIG. 1), part of the manual sheet feeder section TRt which lies on a rotation center TRt0 side thereof is stored in such a state that the rotation center side part thereof is located below the cartridge mount member KS and enters a space defined to the left of the developer storage container RT, whereby the manual sheet feeder section TRt is stored in such a state that the image forming apparatus U is made compact in size as a whole to save space.

The sheet S transferred to the register roll Rr is transported from a pre-transfer sheet guide SG, which is an example of a guide member, on to the transfer belt TB of the transfer unit TU at the same timing as the toner image on the photoconductor drum PR is moved to the transfer area Q3. The transfer belt TB transports the sheet S so transported thereto to the sheet transfer area Q3.

The toner image Tn developed on the surface of the photoconductor drum PR is transferred on to the sheet S by the transfer roll TR in the transfer area Q3. After the transfer of the toner image, the surface of the photoconductor drum PR is cleaned by a cleaning brush CLp1, which is an example of a developer removing member, of a photo conductor drum cleaner CLp, which is an example of a developer recovering device, whereby the residual toner is removed. The residual toner so removed by the cleaning brush CLp1 is then transported by a photoconductor drum toner transporting member, which is an example of the developer transporting member. The surface of the photoconductor drum PR, which has been so cleaned, is charged again by the charge device CR.

The sheet S, on to which the toner image has been transferred by the transfer roll TR in the transfer area Q3, is separated from the surface of the transfer belt TB by the separator claw SC lying downstream of the transfer area Q3. The surface of the transfer belt TB, from which the sheet S has been separated, is cleaned by a cleaning blade CLb1, which is an example of a developer removing member of a belt cleaner CLb. Toner, paper dust, discharge generating substance and the like which have been removed by the cleaning blade CLb1 are transported by a belt toner transporting member CLb2, which is an example of the developer transporting member.

After the toner image transferred thereon is heated and fixed by a fixing device having a heating roll Fh, which is an example of a heating member, and a pressure roll Fp, which is an example of a pressurizing member, the sheet S so separated passes through a transporting path switching member MG which is made of an elastic sheet and is transported to a transporting member Rb which can rotate forwards and backwards in a discharge path SH2. The transporting path switching member MG deforms elastically so as to direct the sheet S which has passed the fixing device F to the discharge path SH2.

The sheet S, which is to be discharged to a sheet discharge section TRh, is transported through the discharge path SH2 along which the transporting member Rb which can rotate forwards and backwards and a plurality of transporting members Ra. A post-processing selector member GT1 is disposed at a downstream end portion of the discharge path SH2. The post-processing selector member GT1 is changed over to select the discharge of sheets S which are transported thereto between the sheet discharge section TRh and a post-processing unit, which is not shown, when the post-processing unit, not shown, is connected to the image forming apparatus. In addition, in such a state that the post-processing unit is not attached to the image forming apparatus, the post-processing selector member GT1 discharges sheets S transported to the downstream end portion of the discharge path SH2 to the sheet discharge section TRh.

When a sheet on one side of which information has already been recorded is transferred thereto for double-side printing, the transporting member Rb which can rotate forwards and backwards rotates backwards immediately before a rear end of the one-side recorded sheet S has passed the transporting member Rb so as to transport the one-side recoded sheet S to an opposite direction to the direction in which the sheet S has been transported (or switches back the sheet S, in other words). The transporting path selector member MG directs the sheet S so switched back to a circulating transporting path SH3 by the transporting member Rb. The one-side recorded sheet S so transported to the circulating transporting path SH3 is transported again to the transfer area Q3 in such a state that the front surface of the sheet S is turned downwards. A toner image is then transferred to the second surface of the one-side recorded sheet S transported to the transfer area Q3 again.

Note that a sheet transport unit SH is made up of the constituent elements denoted by reference numerals SH1 to SH3, Rp, Rs, Rr, Ra, Rb, MG and the like.

(Waste Developer Transporting Apparatus)

Figure 2:
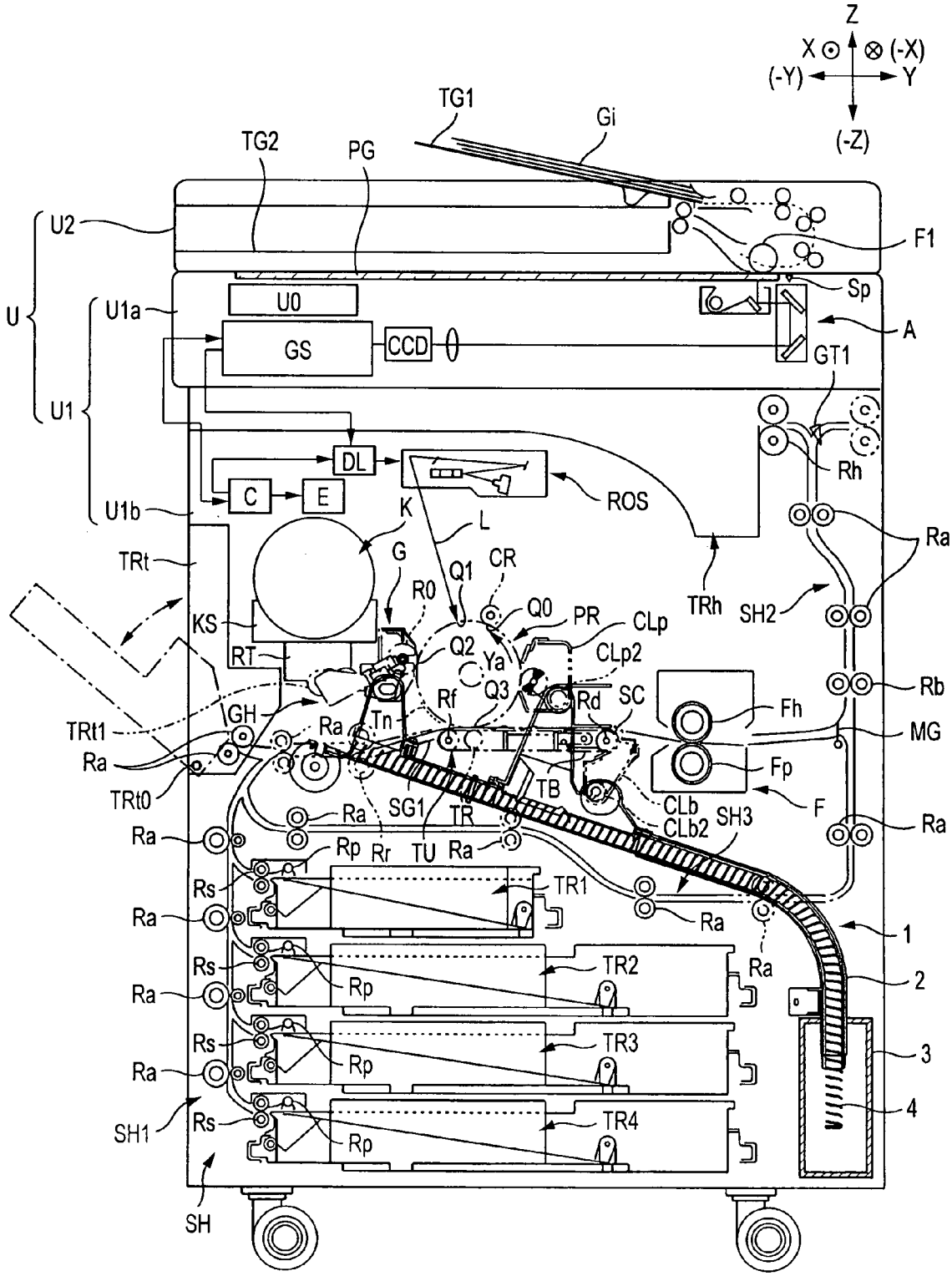
FIG. 2 is an explanatory drawing showing the whole of a waste developer transporting apparatus which is an example of a developer transporting apparatus of Embodiment of the invention.

FIG. 2 is an explanatory drawing showing the whole of a waste developer transporting apparatus which is an example of a developer transporting apparatus of Embodiment of the invention.

Figure 3:
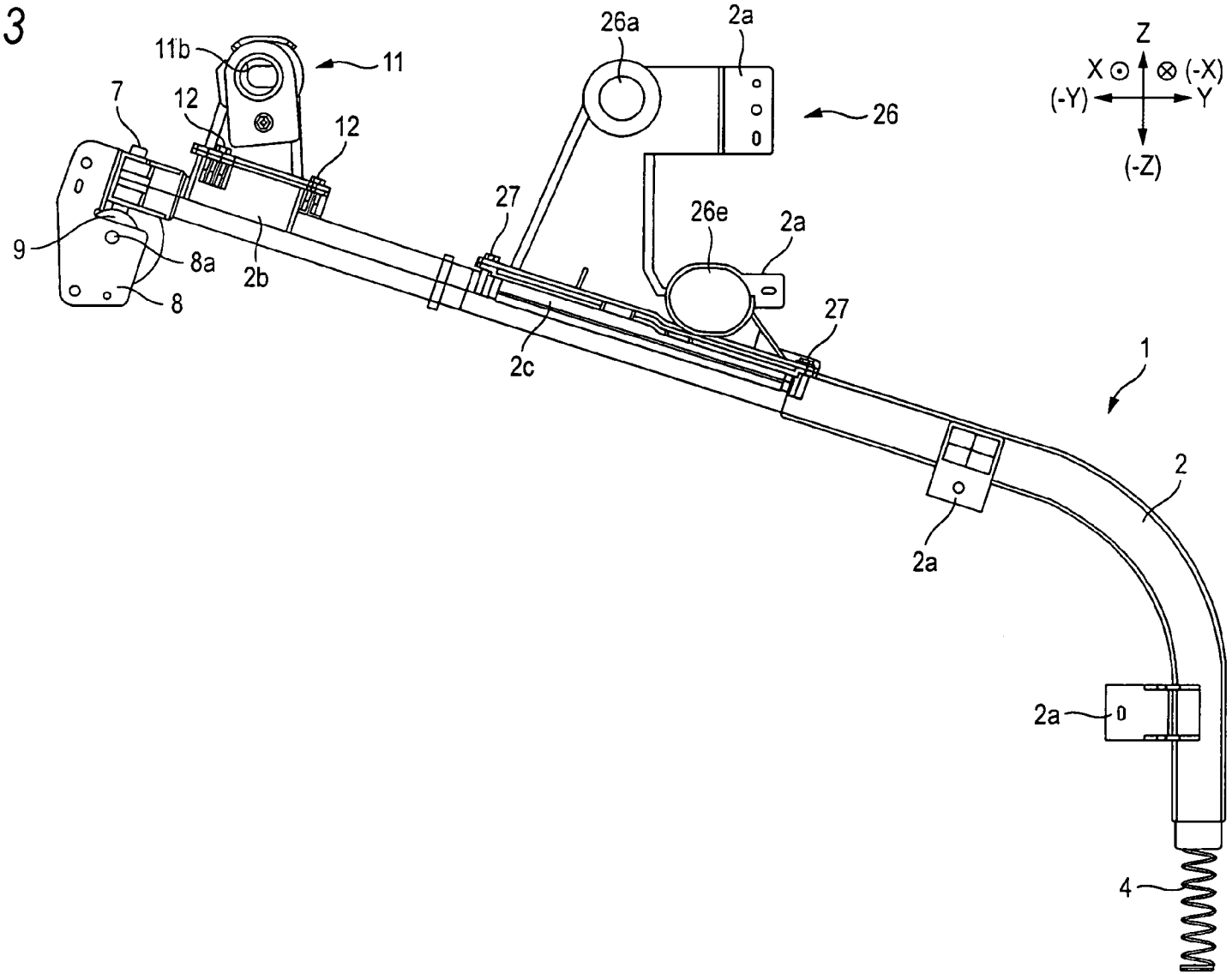
FIG. 3 is a front view of the waste developer transporting apparatus shown in FIG. 2.

FIG. 3 is a front view of the waste developer transporting apparatus shown in FIG. 2.

Figure 4:
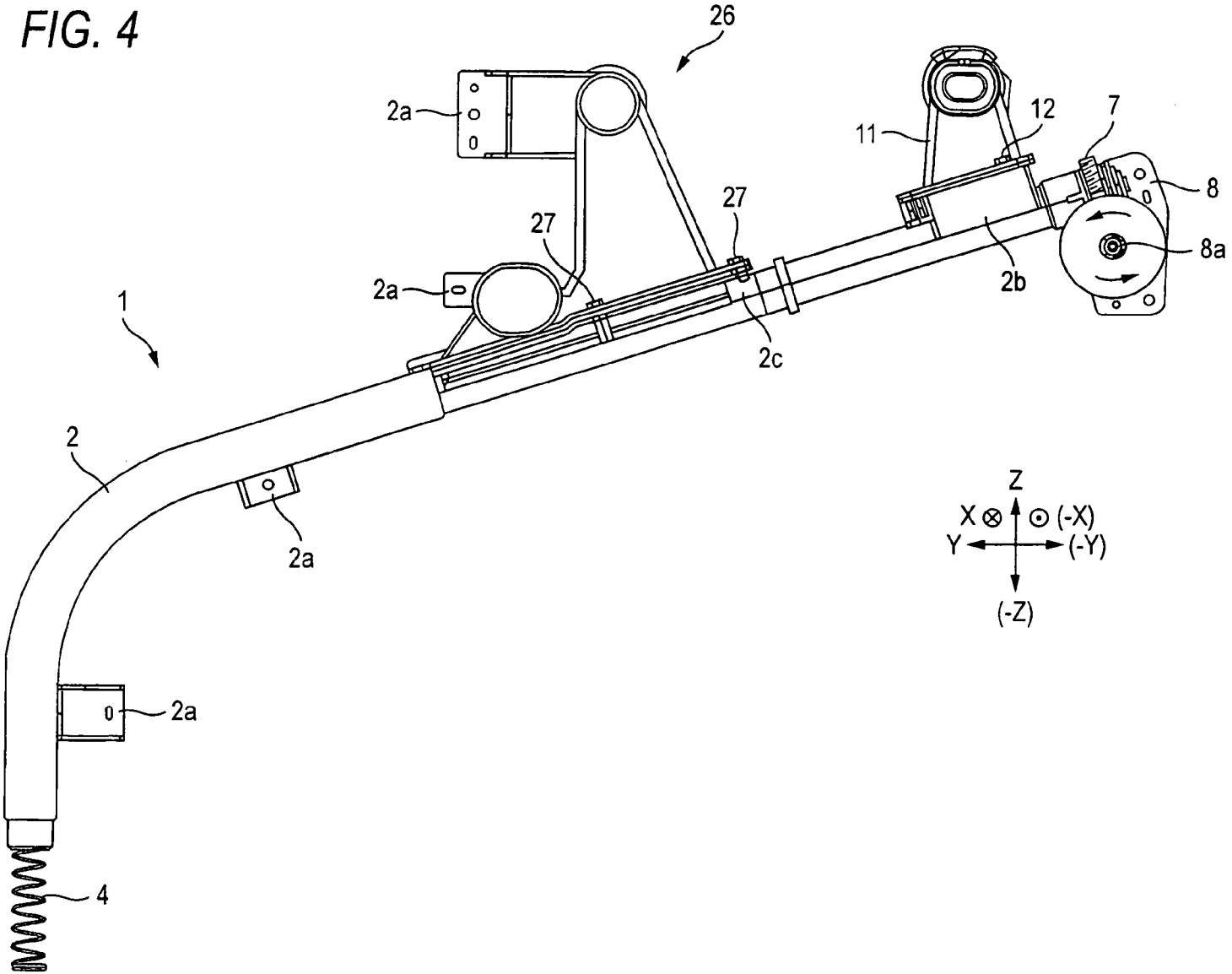
FIG. 4 is a rear view of the waste developer transporting apparatus shown in FIG. 3.

FIG. 4 is a rear view of the waste developer transporting apparatus shown in FIG. 3.

Figure 5:
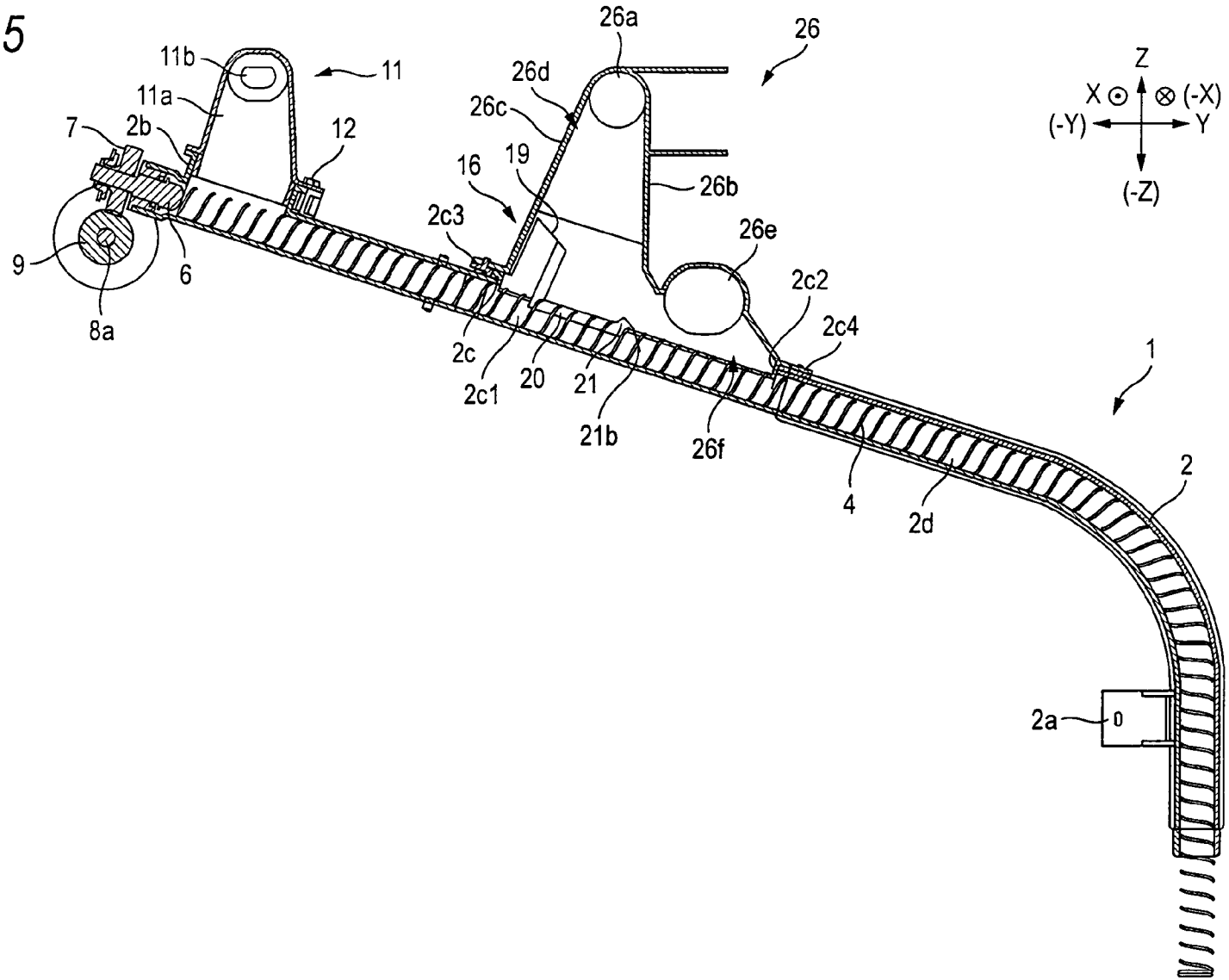
FIG. 5 is a sectional view of a main part of the waste developer transporting apparatus shown in FIG. 2.

FIG. 5 is a sectional view of a main part of the waste developer transporting apparatus shown in FIG. 2.

Figure 6:
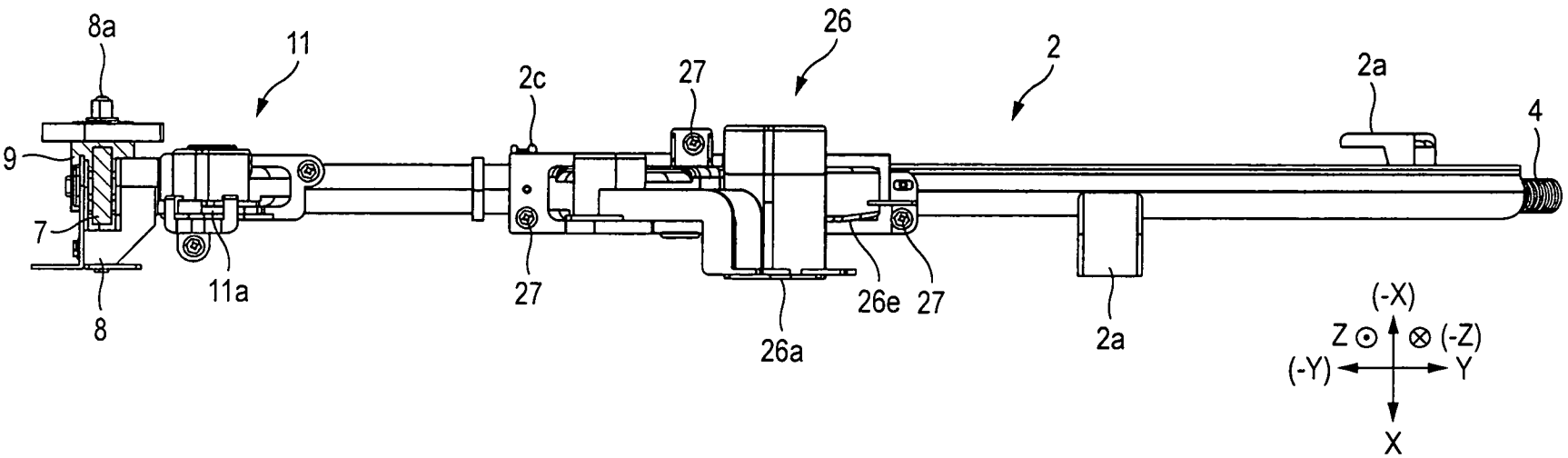
FIG. 6 is a plan view of the waste developer transporting apparatus of Embodiment 1 shown in FIG. 5.

FIG. 6 is a plan view of the waste developer transporting apparatus of Embodiment 1 shown in FIG. 5.

In FIGS. 2 to 6, a waste developer transporting apparatus 1, which is an example of a developer transporting apparatus of the invention has a substantially L-shaped, hollow cylindrical transporting path forming member 2 which forms a waste toner transporting path 2*d* which is an example of a developer transporting path and a waste toner recovery container 3 which is an example of a developer recovery section connected to right lower end of the transporting path forming member 2. The transporting path forming member 2 has a plurality of fixed portions 2*a* which are fixedly screwed to fixing portions provided on a rear side of a main body of the photocopying machine U1, not shown. A first drop connecting portion 2*b* is formed at a left upper portion of the transporting path forming member 2, and a second drop path connecting portion 2*c* is formed at a central portion of the transporting path forming member. In addition, a so-called coil auger 4, which is a transporting member formed into a coil shape by winding a wire material into a cylindrical shape and is an example of a developer transporting member, is rotatably accommodated in a waste toner transporting path 2*d* which is made up of an interior space in the transporting path forming member 2, and an end of the coil auger 4 extends into an interior of the waste developer recovering section 3.

A left upper end of the coil auger 4 is supported by a transporting member end portion support member 6 which is rotatably supported by the transporting path forming member 2 via a bearing. A driven gear 7 is fixedly supported on the transporting member end portion support member 6. A drive motor 8, which is an example of a drive unit, is fixedly supported at a left upper end portion of the transporting path forming member 2, a drive gear 9 supported on a drive shaft 8a of the drive motor 8 is brought into mesh engagement with the driven gear 7. Consequently, when the drive motor 8 operates, the coil auger 4 rotates via the drive gear 9 and the driven gear 7, whereby a developer residing in the waste toner transporting path 2*d* is transported towards the waster developer recovering section 3.

In FIG. 5, a first drop path forming member 11 is fixedly supported at the first drop path connecting portion 2*b* with a screw 12. A first drop path 11*a*, which is an example of a drop path connected to the waste toner transporting path 2*d*, is formed in an interior of the first drop path forming member 11, and a first developer drop port 11*b*, which is an example of a developer drop port, is formed at an upper end portion of the first drop path 11. A waste developer transporting member (not shown) which transports waste developer discharged in a small amount from the developing device G is connected to the first developer drop port 11*b* for communication. Consequently, a discharged developer that is discharged from the developing device G is trans ported from the developer drop port 11 to the first drop path 11*a*, and the developer which drops through the first drop path 11*a* is transported through the waste toner transporting path 2*d* for recovery into the developer recovering section 3.

(Description of Second Drop Path and Aggregation Preventing Member)

Figure 7:
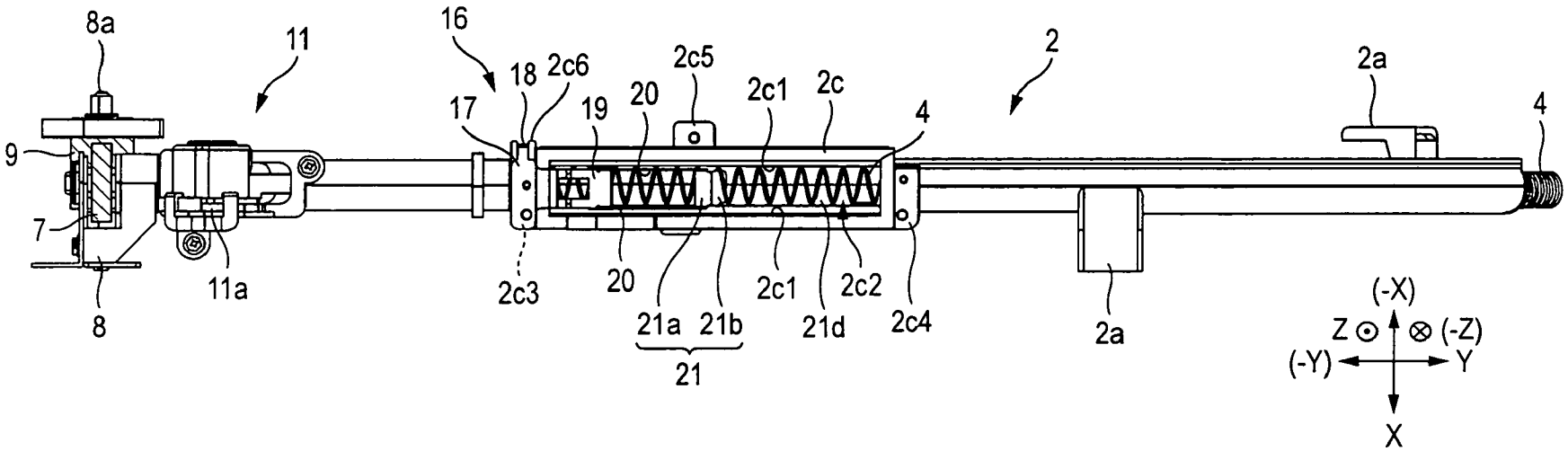
FIG. 7 is an explanatory drawing of the waste developer transporting apparatus of Embodiment 1 with a second drop path forming member removed shown in FIG. 6.

FIG. 7 is an explanatory drawing showing the waste developer transporting apparatus of Embodiment 1 shown in FIG. 6 with the second drop path forming member removed.

Figure 8:
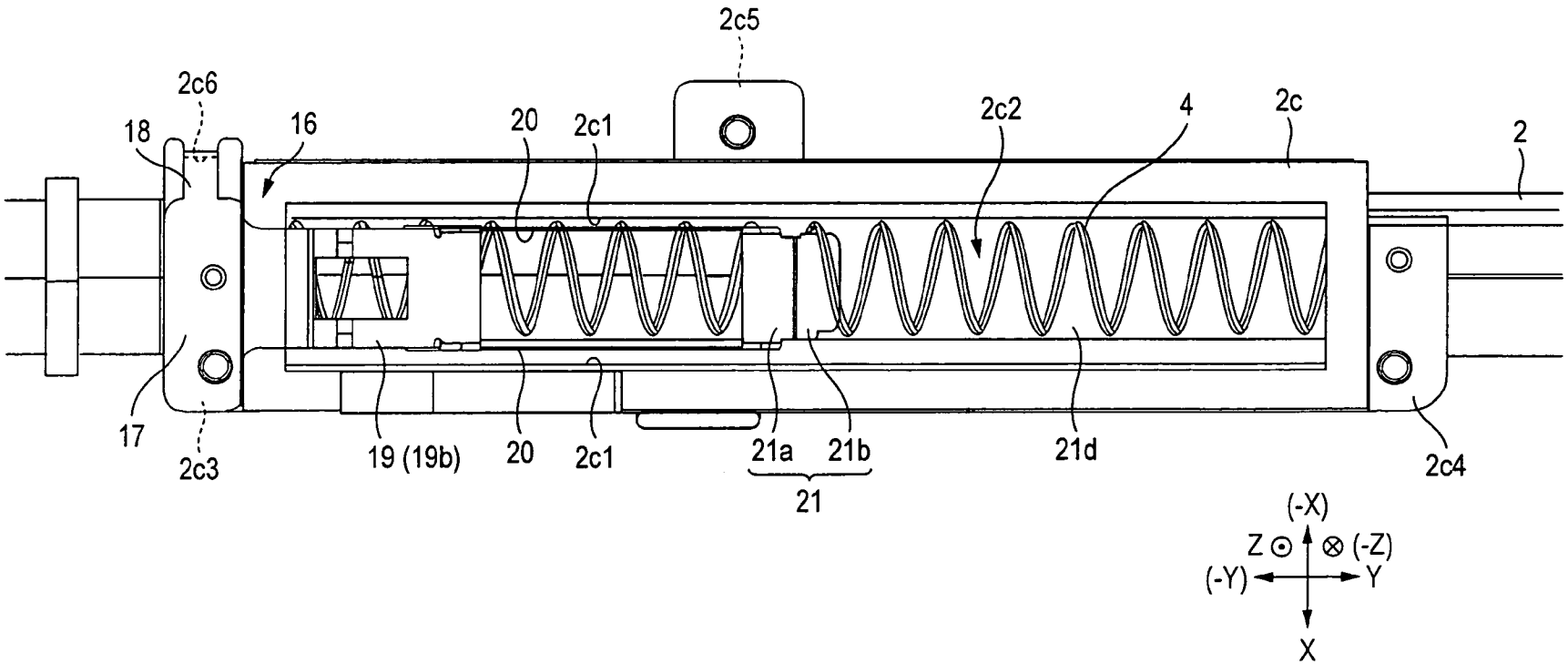
FIG. 8 is an enlarged view of a main part of a second drop path connecting portion of the waste developer transporting apparatus of Embodiment 1 with a second drop path forming member removed shown in FIG. 7.

FIG. 8 is an enlarged view of a main part of the second drop path connecting portion of the waste developer transporting apparatus of Embodiment 1 shown in FIG. 7.

In FIGS. 7, 8, the second drop path connecting portion 2*c* has an inner wall surface 2*c*1 which extends upwards from the waste toner transporting path 2*d*. Consequently, in the waste toner transporting path 2*d*, a lower portion than a rotation center of the coil auger 4, that is, a bottom side portion is formed into a semi-circular shape in cross section which follows an external shape of the coil auger 4 in the position where the second drop path connecting portion 2*c* is provided, while an upper portion is made up of a space surrounded by the inner wall surface 2*c*1 which extends upwards in a perpendicular direction, whereby a gap between the inner wall surface 2*c*1 and the coil auger 4 is formed into a wedge shape which narrows as it extends downwards. In addition, a rectangular opening 2*c*2, as viewed from the top, is formed at an upper end of the inner wall surface 2*c*1. Member fixing portions 2*c*3, 2*c*4, 2*c*5 are formed at left, right and rear portions on a perimetric edge of the opening 2*c*2, and screw holes are formed in the respective member fixing portions 2*c*3 to 2*c*5. In addition, a U-shaped held portion 2*c*6 is formed at a rear portion of the left-side member fixing portion 2*c*3.

Figure 9:
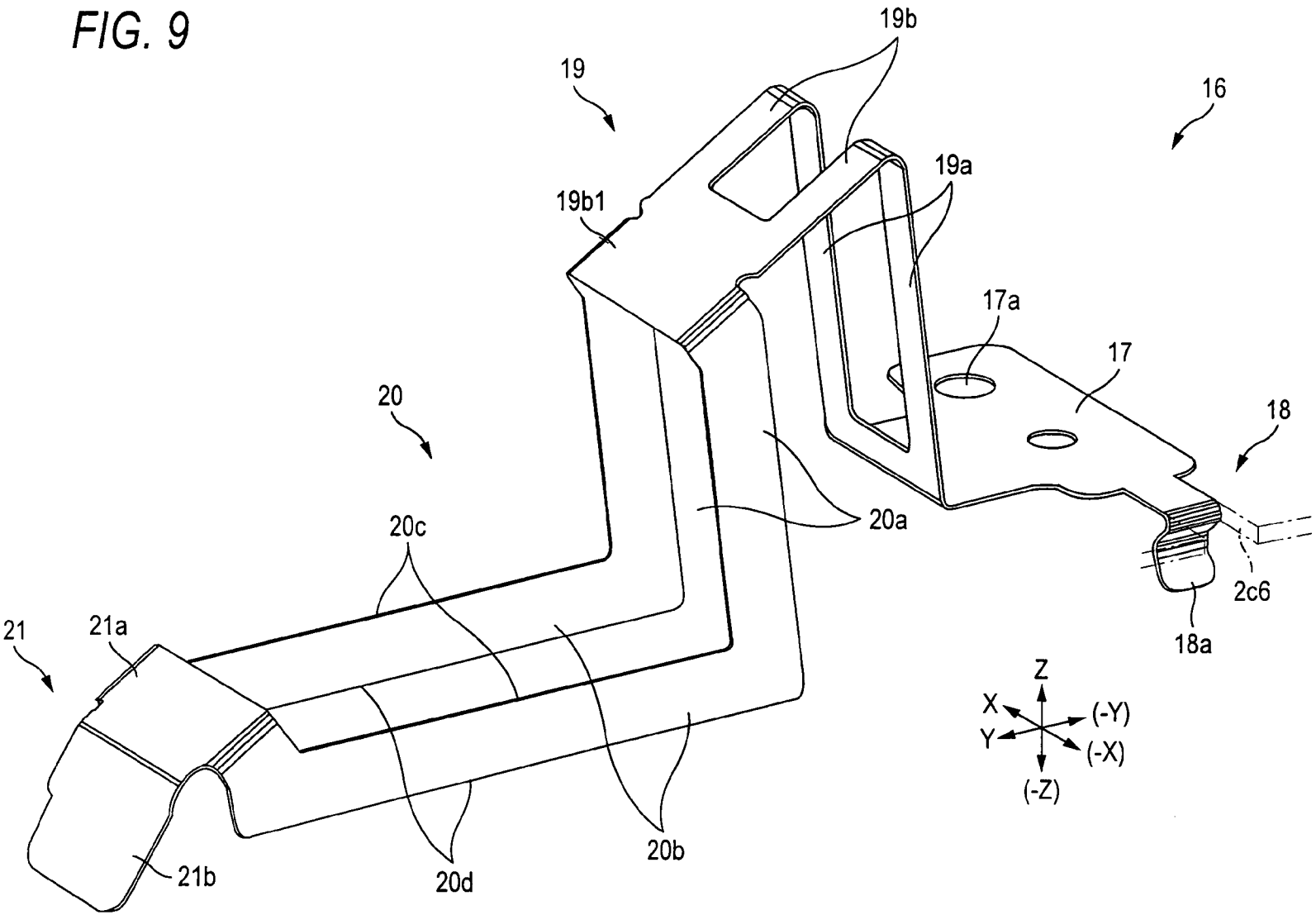
FIG. 9 is a explanatory perspective view of an aggregation preventing member of Embodiment 1.

FIG. 9 is a perspective view of an aggregation preventing member of Embodiment 1.

FIGS. 5 and 7 to 9, an aggregation preventing member 16 of Embodiment 1 is supported at the second drop path connecting portion 2*c*. In FIG. 9, the aggregation preventing member 16 has a fixed portion 17 which is supported on an upper surface of the left-side member fixing portion 2*c*3. A screw passage hole 17*a* is formed in the fixed portion 17. A holding portion 18, which is curved substantially into a laterally oriented U-shape, is formed integrally at the rear of the fixed portion 17, and an operating portion 18*a* is formed at a lower end of the holding portion 18 for operation by an operator who performs an attaching or detaching operation of the aggregation preventing member 16. Consequently, the aggregation preventing member is supported on the member fixing portion 2*c*3 by elastically deforming the holding portion 18 to hold the held portion 2*c*6 as by a clip and holding the holding portion 18 in such a state.

A plate spring portion 19, which can elastically deform, is formed integrally on a right side (in a +Y direction in FIG. 9) of the fixed portion 17. The plate spring portion 19 has an upwardly extending portion 19*a* which extends upwards in a perpendicular direction from a right end of the fixed portion 17 and an obliquely extending portion 19*b* which extends from an upper end of the upwardly extending portion 19*a* to the right while inclined downwards. Since the respective extending portions 19*a*, 19*b* close an area through which a developer drops, with a view to reducing a projection area as viewed from the top, while the extending portions are each formed into a pair of strip-like shapes which extend parallel to each other, a plate spring reinforcement portion 19*b*1 is formed on the obliquely extending portion 19*b* in such a manner as to connected thereto in a longitudinal direction with a view to securing a required strength.

A pair of L-shaped developer scrub-off portions 20 are formed at a right end of the obliquely extending portion 19*b* of the plate spring portion 19. In the developer scrub-off portions 20, a pair of perpendicular portions 20*a* which extend perpendicularly downwards and a pair of strip-like scrub-off portions 20*b* which extend from lower ends of the perpendicular portions 20*a* to a rightward direction, that is, in the developer transport direction of the waste toner transporting path 2*d* are formed integrally with each other. Edge portions 20*c* and 20*d* are formed on both upper and lower edges of the developer scrub-off portion 20. In FIG. 10F, the strip-like scrub-off portions 20*b* of Embodiment 1 are disposed along the inner wall surface 2*c*1 of the waste toner transporting path 2*d* which is provided on an upper outer side of the coil auger 4, and a width or spacing distance between the scrub-off portions 20*b* is made wider an outside diameter of the coil auger 4 bus is made narrower than an inside diameter of the inner wall surface 2*c*1 so that developer is caused to stick to the inner wall surface 2*c*1 by the coil auger 4 being kept in contact with the inner wall surface 2*c*1. Note that the strip-like scrub-off portions 20*b* are disposed in such a manner as to be brought into contact with the inner wall surface 2*c*1 and separated therefrom as they move vertically.

An aggregation preventing member distal end portion 21 is integrally formed at a right end portion of the developer scrub-off portion 20. The aggregation preventing member distal end portion 21 has a distal end reinforcement portion 21*a* which connects to right end portions of the strip-like scrub-off portions so as to reinforce them and a contact portion 21*b* which is formed on a right side of the distal end reinforcement portion 21*a* in such a manner as to extend obliquely downwards. As is shown in FIG. 8, the contact portion 21*b* of Embodiment 1 is disposed in such a manner as to enter the inside of the coil spring-like coil auger 4. In addition, a lower side portion of the contact portion 21*b* is formed narrower in width than the distal end reinforcement portion 21*a* so that the movement thereof is not restricted by a contact with the waste toner transporting path 2*d* which is formed into the semi-circular shape in cross section at the lower portion thereof in such a manner that the width thereof is narrowed gradually increasingly as it extends towards the bottom side thereof, which contact would otherwise occur.

In FIGS. 5 to 8, a second drop path forming member 26 is supported at the second drop path connecting portion 2*c*. The second drop path forming member 26 is fixedly supported by screws 27 which are screwed into the screw holes in the member fixing portions 2*c*3, 2*c*4, 2*c*5 and the screw passage hole 17*a* in the aggregation preventing member 16.

In FIG. 5, a second developer drop port 26*a*, which is an example of a developer drop port, is formed at an upper end portion of the second drop path forming member 26, and a rear end portion of the photoconductor drum toner transporting member CLp2 is connected to the second developer drop port 26*a* for communication. The second drop path forming member 26 has below the first developer drop port 26*a* a drop path perpendicular inner wall 26*b* which extends downwards in a perpendicular direction and a drop path inclined inner wall 26*c* which extends to the left while inclined downwards, whereby a second drop path 26*d*, which is an example of a drop path, is formed by a space defined by the drop path perpendicular inner wall 26*b* and the drop path inclined inner wall 26*c*. Consequently, in the second drop path forming member 26, a space between the drop path perpendicular inner wall 26*b* and the drop path inclined inner wall 26*c* is made to be broader as it extends downwards, and therefore, the second drop path 26*d* is formed into a so-called divergent shape. As a result, the aggregation preventing member 16 is formed into a shape which match the divergent shape of the second drop path, and the plate spring portion 19 is not disposed below the second developer drop port 26*a* in the perpendicular direction, instead, the strip-like scrub-off portions 20*b* and the aggregation preventing member distal end portion 21 being disposed.

A developer transported to the second developer drop port 26*a* by the photoconductor drum toner transporting member CLp2 drop through the second drop path 26*d* to be transported to the waste toner transporting path 2*d*.

In FIG. 5, a third developer drop port 26*e* is formed at a portion lying to the right of the second drop path forming member, and a rear end portion of the belt toner transporting member CLb2 is connected to the third developer drop port 26*e* for communication. A third drop path 26*f*, which is an example of a drop path, is formed below the third developer drop path 26*e*, and a developer transported to the third developer drop port 26*e* by the belt toner transporting member CLb2 drops through the third drop path 26*f* to be transported to the waste toner transporting path 2*d*.

FUNCTION OF EMBODIMENT 1

In the waste developer transporting apparatus 1 of Embodiment 1 which has the configuration that has been described heretofore, the developer, paper dust and the like which are recovered at the developing device G, the photoconductor drum cleaner CLp and the belt cleaner CLb drop through the corresponding drop paths 11*a*, 26*d*, 26*f* to be transported to the waste toner transporting path 2*d*. the developer residing inside the waste toner transporting path 2*d* is transported by the developer transport device 4 which rotates to thereby be recovered into the waste developer recovering section 3.

When the coil auger 4 rotates, the spirally shaped coil auger 4 and the contact portion 21*b* of the aggregation preventing member distal end portion 21 are brought into intermittent contact with each other, whereby the coil auger 4 is pushed in a vertical direction. In association with this, the aggregation preventing member 16 moves vertically or vibrates with the connecting portion between the fixed portion 17 and the plate spring portion acting as a fixed end and the contact portion 21*b* acting as a free end. In addition, this vibration is amplified by the plate spring portion 19 which is curved into the U-shape. The developer scrub-off portion 20 is caused to move in the vertical direction along the inner wall surface 2*c*1 and the inner wall surface of the second drop path 26*d* by the vibration.

Figure 10A:
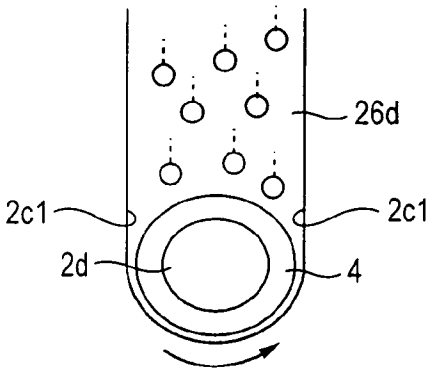
Figure 10B:
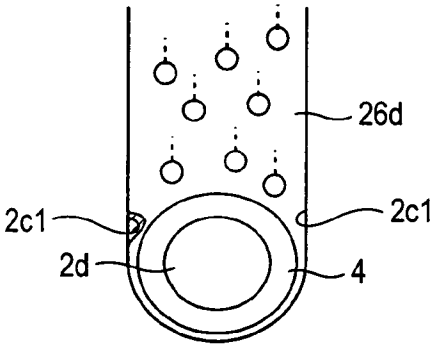
Figure 10C:
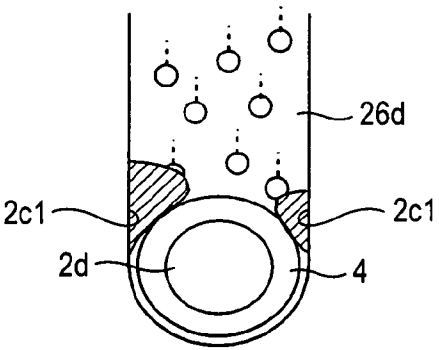
Figure 10D:
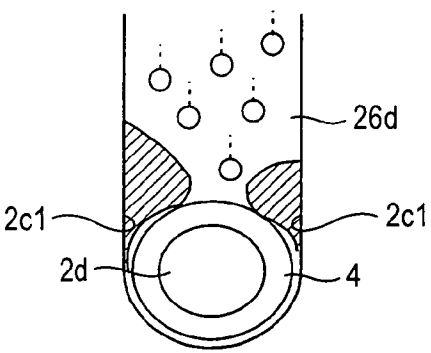
Figure 10E:
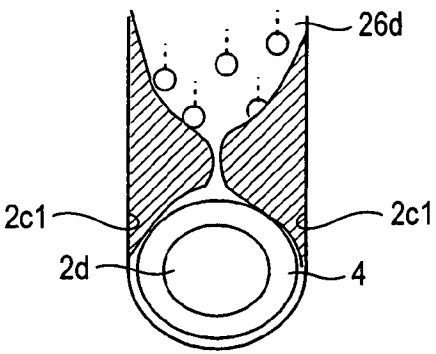
Figure 10F:
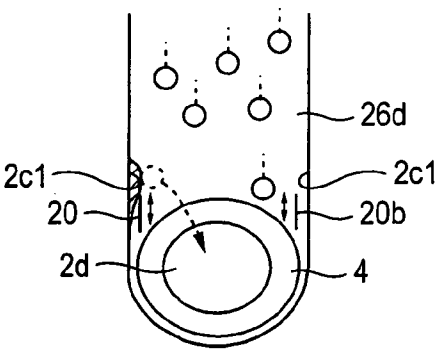

FIG. 10 shows drawings which describe the function of Embodiment 1, in which FIG. 10A is an explanatory drawing which describes an initial state of a conventional waste developer transporting apparatus, FIG. 10B is an explanatory drawing which describes a state in which a developer starts sticking to an inner wall surface from the state shown in FIG. 10A, FIG. 10C is an explanatory drawing which shows a state in which the developer that has continued to stick from the state shown in FIG. 10B is now growing into aggregates, FIG. 10D is an explanatory drawing which shows a state in which the aggregates of developer have grown further from the state shown in FIG. 10C, FIG. 10E is an explanatory drawing which shows a state in which the aggregates of developer have grown further from the state shown in FIG. 10D to clog the drop path, and FIG. 10F is an explanatory drawing of the waste developer transporting apparatus 1 of Embodiment 1.

In FIG. 10, in the waste developer transporting apparatus 1 of Embodiment 1, since the strip-like scrub-off portions 20*b* which are disposed along the inner wall surface 2*c*1 of the waste toner transporting path 2*d* vibrate on the outside of the upper portion of the coil auger 4, even in the event that a developer which drops through the second drop path 26*d* sticks to the inner wall surface 21*c*, the developer that has so stuck to the inner wall are scrubbed off by the upper and lower edge portions 20*c*, 20*d* at the upper and lower edges of the strip-like scrub-off portions 20*b*. Namely, in the conventional technique in which the aggregation preventing member 16 is not provided, while there have occurred cases where the developer which started to stick to the inner wall surface 2*c*1 grows into aggregates to clog the second drop path 26*d* therewith as the stages shown in FIGS. 10A to 10F have been completed, in the embodiment of the invention, since the developer is scrubbed off into the waste toner transporting path 2*d* by the aggregation preventing member 16 which is disposed between the coil auger 4 and the inner wall surface 2*c*1 in the stage shown in FIG. 10B in which the developer has started to stick between the coil auger 4 and the inner wall surface 2*c*1, the growth of aggregates which have grown from the developer sticking to the inner wall surface is disturbed.

In particular, much of the developer which drops through the second drop path 26*d* is deteriorated due to electric field and physical force being applied thereto at the developing area Q2 and the transfer area Q3 and is hence easy to aggregate. Moreover, the developer in the second drop path 26*d* is subjected to force applied by the coil auger 4. Therefore, the developer which drops through the second drop path 26*d* or the like sticks little to the wall surface 26*b* during dropping and tends to stick easily to, in particular, the inner wall surface 2*c*1 on the outside of the upper portion of the downstream end of the coil auger 4 in its rotating direction. However, since the developer attempting to stick thereto is scrubbed off by the aggregation preventing member 16 which is disposed in this position, the growth of aggregates can be disturbed effectively.

In addition, since the gap is opened inside the inner wall surface 2*c*1, the developer dropping through the second drop path 26*d* sticks little to the inner wall surface 2*c*1, and since the projecting area of the aggregation preventing member 16 is narrow, the developer so dropping is difficult to stick on to the aggregation preventing member 16. Therefore, much of the developer so dropping through the second drop path 26*d* is transported to the waste developer transporting path 2*d*. Even in the event that the developer sticks to the aggregation preventing member 16, since the developer drops on to the developer scrub-off portion 20 which is disposed below the second developer drop port 26*a* in the perpendicular direction, so as to drop on the portion of the aggregation preventing member 16 which lies away from the fixed end thereof, whereby the developer that has so dropped on to the aggregation preventing member 16 is caused to drop into the waste toner transporting path 2*d* by virtue of the vibration of the developer scrub-off portion 20 whose amplitude becomes larger than that of the spring portion 19.

EMBODIMENT 2

Figure 11:
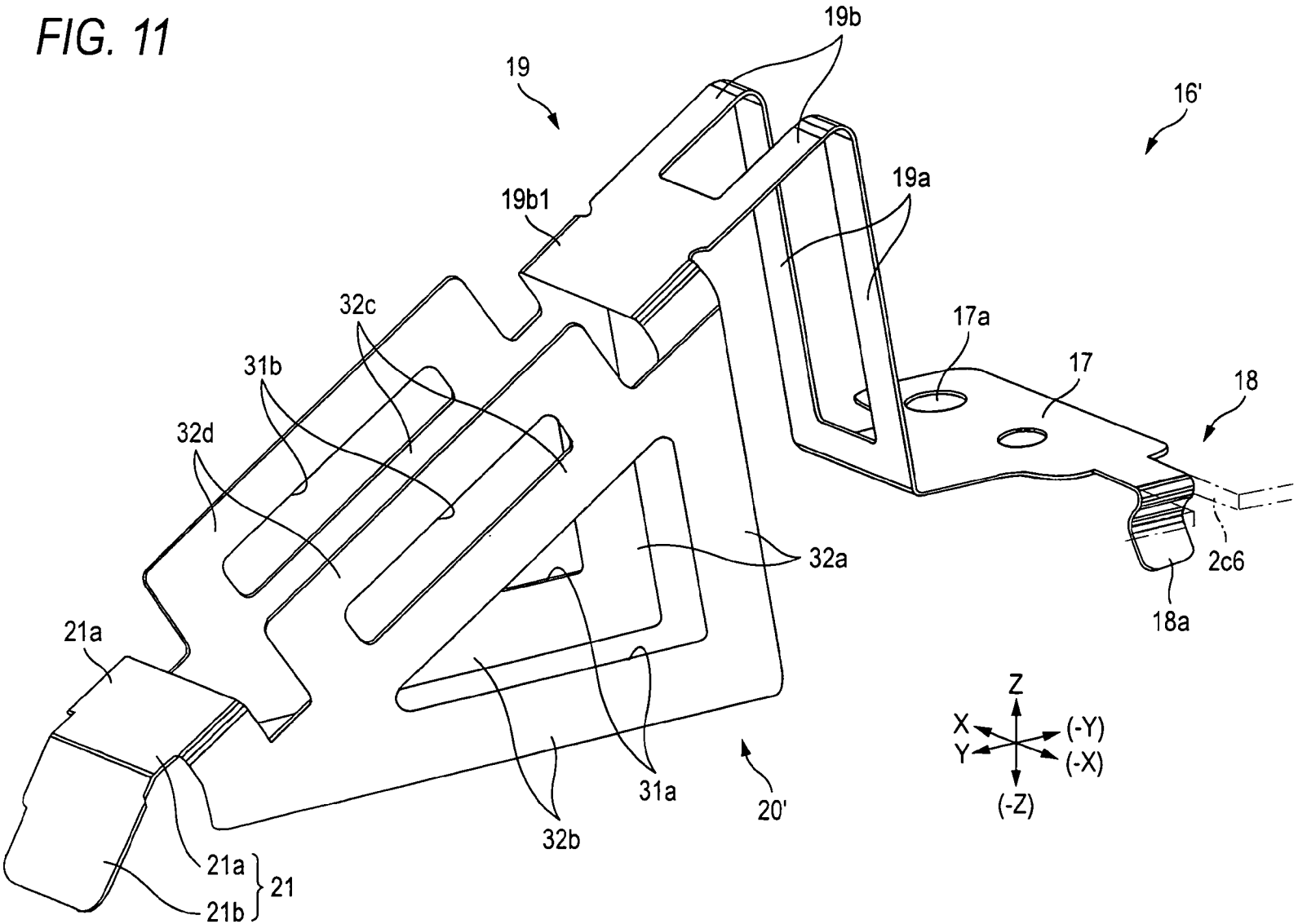
FIG. 11 is an explanatory perspective view which describes an aggregation preventing member of Embodiment 2 of the invention, the perspective view corresponding to FIG. 9 which illustrates Embodiment 1.

FIG. 11 is an explanatory perspective view which describes an aggregation preventing member of Embodiment 2 of the invention, the perspective view corresponding to FIG. 9 which illustrates Embodiment 1.

Next, an image forming apparatus will be described below which includes an aggregation preventing member of Embodiment 2 of the invention. In the description of Embodiment 2, like reference numerals will be imparted to like constituent elements to those of Embodiment 1, and a detailed description thereof will be omitted here. While Embodiment 2 differs from Embodiment 1 in the following points, Embodiment 2 is identical in configuration to Embodiment 1 with respect to the other points.

In FIG. 11, in an aggregation preventing member 16' of Embodiment 2, a developer scrub-off portion 20' is formed into a right-angled triangle having a wider area than the developer scrub-off portion of Embodiment 1. A lower opening 31*a*, which is formed into a lower triangular shape, and an upper opening 31*b*, which is formed into an upper rectangular shape, are formed in the aggregation preventing member 16'. Consequently, the aggregation preventing member 16' of Embodiment 2 has perpendicular portions 32*a* and lower scrub-off portions 32*b* which are similar to the perpendicular portions 20*a* and the strip-like scrub-off portions 20*b* of Embodiment 1, first oblique scrub-off portions 32*c* which extend along an oblique side of the right-angled triangle and second oblique scrub-off portions 32*d* which are parallel to the first oblique scrub-off portions 32*c*.

FUNCTION OF EMBODIMENT 2

In the image forming apparatus U of Embodiment 2 which is configured as has been described above, when the aggregation preventing member 16' vibrates as a coil auger 4 rotates, a developer sticking to an inner wall surface 2*c*1 is scrubbed off by upper and lower edges of the lower scrub-off portions 32*b* and upper and lower edges of the oblique scrub-off portions 32*c*, 32*d*.

EMBODIMENT 3

Figure 12A:
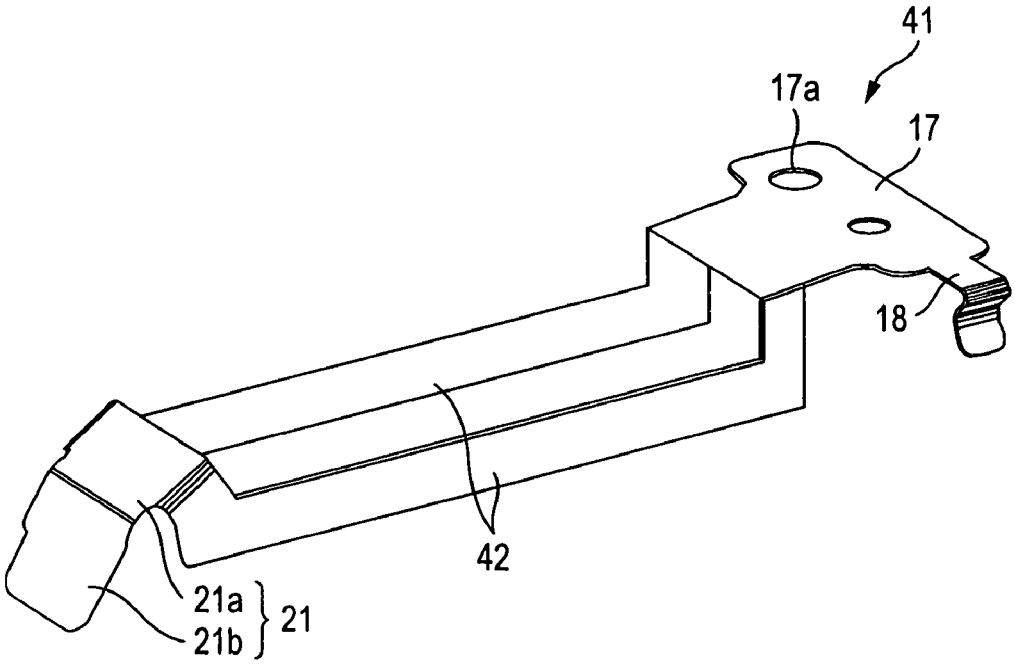
Figure 12B:
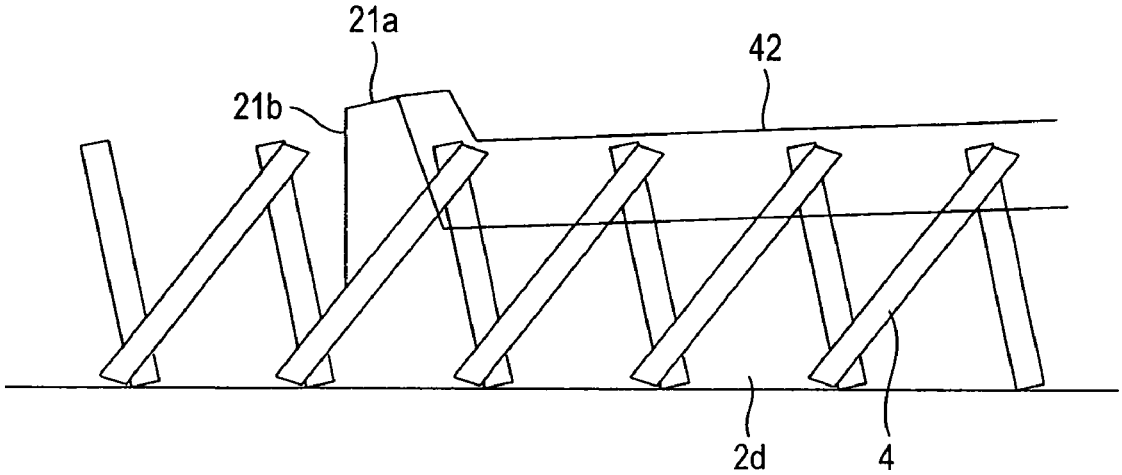

FIG. 12 shows explanatory drawings of an aggregation preventing member of Embodiment 3 of the invention, in which FIG. 12A is an explanatory perspective view of the aggregation preventing member which corresponds to FIG. 9 illustrating Embodiment 1, and FIG. 12B is a sectional view of a main part of the aggregation preventing member which corresponds to FIG. 5 illustrating Embodiment 1.

Next, an image forming apparatus will be described below which includes an aggregation preventing member of Embodiment 3 of the invention. In the description of Embodiment 3, like reference numerals will be imparted to like constituent elements to those of Embodiment 1, and a detailed description thereof will be omitted here. While Embodiment 3 differs from Embodiment 1 in the following points, Embodiment 3 is identical in configuration to Embodiment 1 with respect to the other points.

In FIG. 12, an aggregation preventing member 41 of Embodiment 3 is such that the plate spring portion 19 in the aggregation preventing member 16 of Embodiment 1 is omitted, and developer scrub-off portions 42 extend directly from a fixed portion 17.

FUNCTION OF EMBODIMENT 3

In the image forming apparatus U of Embodiment 3 which is configured as has been described above, a contact portion 21*b* fluctuates vertically as a coil auger 4 rotates, the aggregation preventing member 41 vibrates with a connecting portion between the developer scrub-off portions 42 and the fixed portion 17 functioning as a fixed end. Consequently, while the amplitude of the aggregation preventing member 41 resulting when it vibrates becomes small, compared to Embodiment 1 in which the plate spring portion 19 is provided, the developer can be scrubbed off by edges of the upper and lower edge portions of the developer scrub-off portions 42. Consequently, the developer transfer system of Embodiment 3 has a similar function and advantage to those provided by Embodiment 1, as well.

EMBODIMENT 4

Figure 13A:
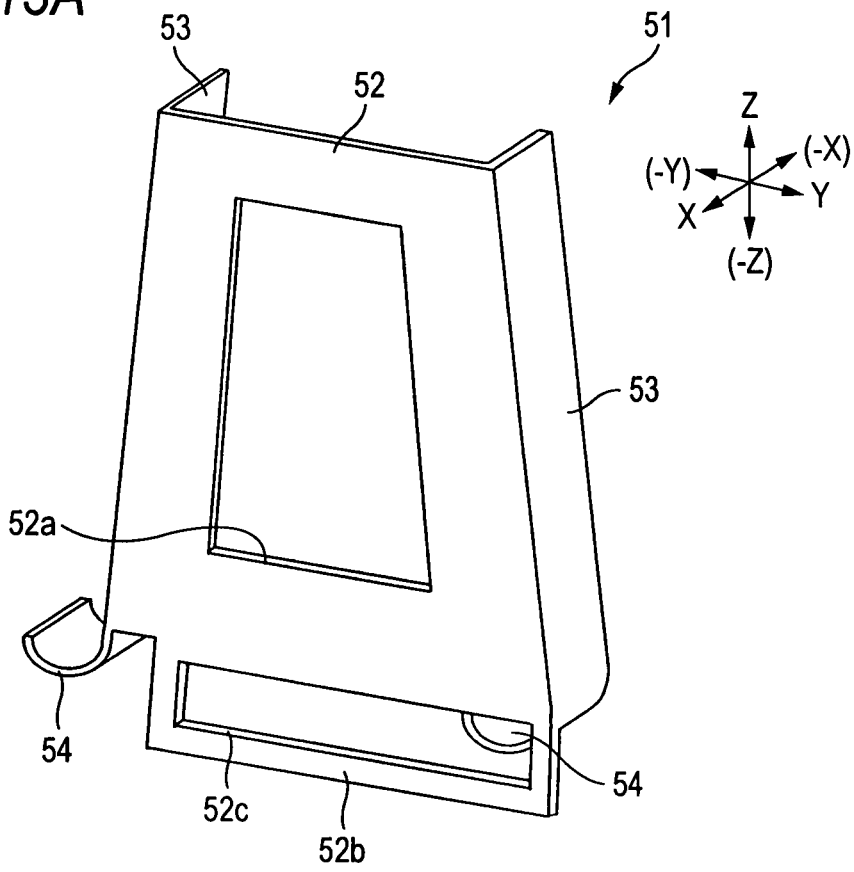
Figure 13B:
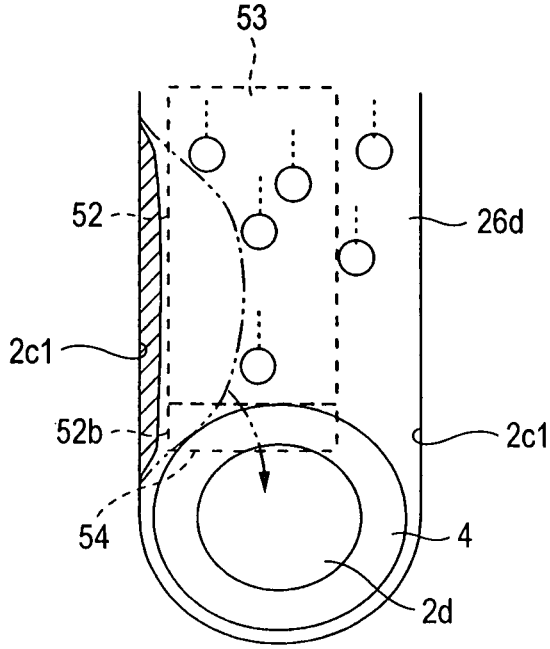

FIG. 13 shows explanatory drawings of an aggregation preventing member of Embodiment 4 of the invention, in which FIG. 13A is an explanatory perspective view of the aggregation preventing member which corresponds to FIG. 9 illustrating Embodiment 1, and FIG. 13B is a sectional view of a main part of the aggregation preventing member which corresponds to FIG. 5 illustrating Embodiment 1.

Figure 14:
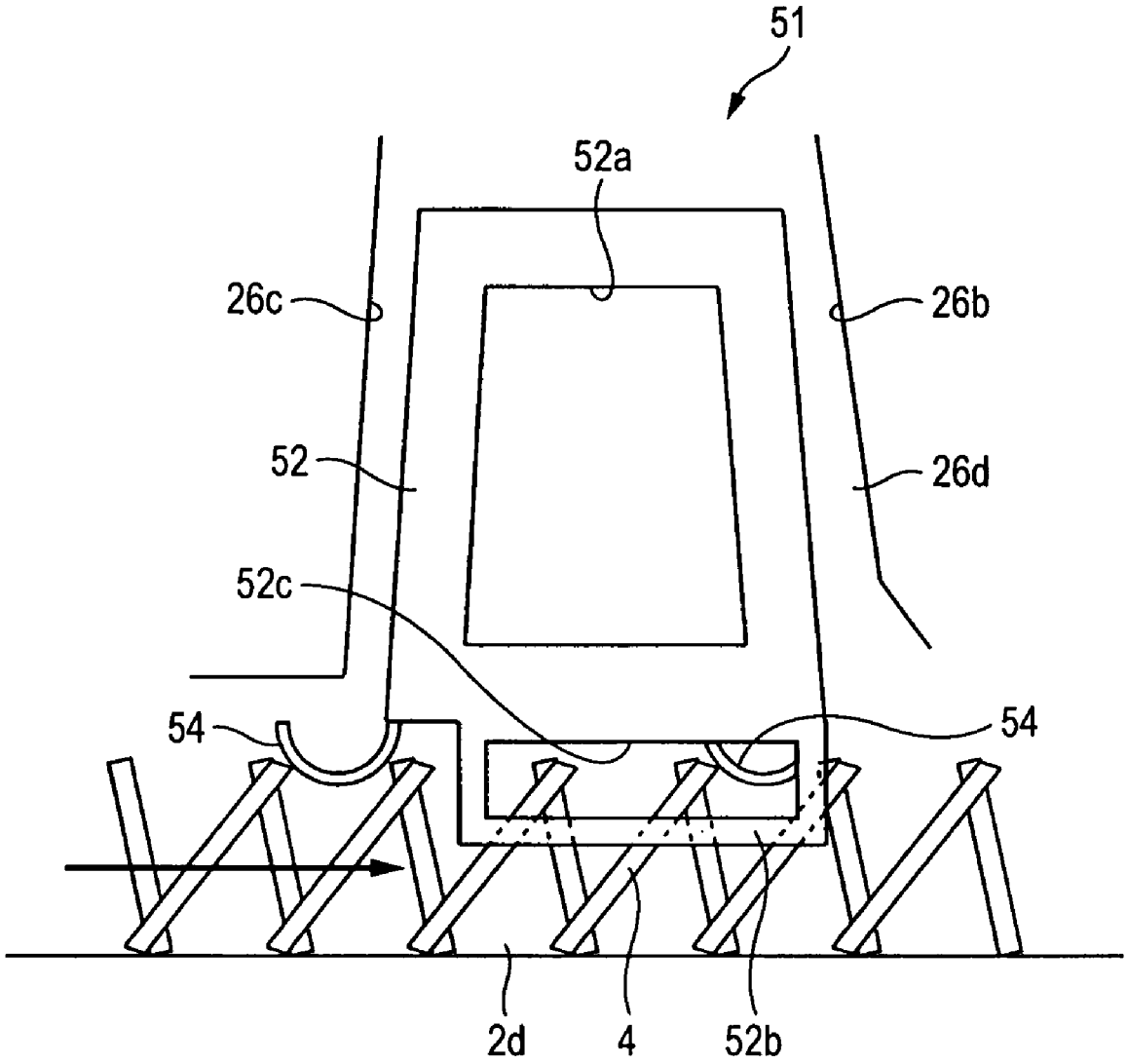
FIG. 14 is explanatory drawing of an aggregation preventing member of Embodiment 4 of the invention, which corresponds to FIG. 5 illustrating Embodiment 1.

FIG. 14 is an explanatory drawing of the aggregation preventing member of Embodiment 4 of the invention and is an explanatory sectional view of the main part of the aggregation preventing member of Embodiment 4 which corresponds to FIG. 5 illustrating Embodiment 1.

Next, an image forming apparatus will be described below which includes an aggregation preventing member of Embodiment 4 of the invention. In the description of Embodiment 4, like reference numerals will be imparted to like constituent elements to those of Embodiment 1, and a detailed description thereof will be omitted here. While Embodiment 4 differs from Embodiment 1 in the following points, Embodiment 4 is identical in configuration to Embodiment 1 with respect to the other points.

In FIG. 13, an aggregation preventing member 51 of Embodiment 4 has a plate-like developer scrub-off portion 52 which is disposed along an inner wall surface 2*c*1 of an upper portion of a waste toner transporting path 2*d* and a front end face of a second drop path 26*d*, a pair of plate-like inner wall contact portions 53 which extend to the rear from both left and right end edges of the developer scrub-off portion 52, respectively, and a pair of left and right contact portions 54 which are curved in an arc-like fashion and are formed at lower end portions of the inner wall contact portions 53, respectively.

An opening 52*a* is formed in a central portion of the developer scrub-off portion 52. An entering portion 52*b* is formed at a lower end portion the developer scrub-off portion 52 in such a manner as to extend downwards and enter between the coil auger 4 and the inner wall 2*c*1, and an opening 52*c* is formed in a central portion of the entering portion 52*b*. As is shown in FIG. 14, an external shape of the developer scrub-off portion 52 is formed such that in such a state that the developer scrub-off portion 52 is accommodated within the second drop path 26*d*, the pair of inner wall contact portions 53 approach a drop path perpendicular inner wall 26*b* and a drop path oblique inner wall 26*c* and are disposed to face the inner walls with a predetermined gap provided therebetween.

In addition, as is shown in FIG. 14, the contact portions,54 are each set to be larger than a gap or pitch between two adjacent constant winding portions of the coil spring-like coil auger 4, so that the whole the contact portions 54 do not fit in between the pitch of the coil auger 4 wholly but sink partially between the pitch.

FUNCTION OF EMBODIMENT 4

In the image forming apparatus U of Embodiment 4 which is configured as has been described above, a developer which has dropped through the second drop path 26*d* is transported to the waste toner transporting path 2*d* by the coil auger 4. When the constantly spiral coil auger 4 rotates, advancing the winding portions thereof, the contact portions 54 which in contact with the coil auger 4 attempt to move in the developer transport direction. As this occurs, since the inner wall contact portions 53 are brought into contact with the perpendicular inner wall 26*b* of the drop path, whereby the movement is restricted, the contact portions 54 which sink between the pitch move vertically in such a manner as to appear from and sink in the pitch as the coil spring-like coil auger 4 rotates. Consequently, the aggregation preventing member 51 moves vertically within the interior of the second drop path 26*d*. In association with the vertical movement of the aggregation preventing member 51, the developer scrub-off portion 52 also moves vertically along the inner wall surface 2*c*1 and the inner wall surface of the second drop path 26*d*. Consequently, the developer sticking to the inner wall surface 2*c*1 and the like is scrubbed off by edges of upper and lower edge portions of the developer scrub-off portion 52, edges of the of the opening 52*a* and edges of the entering portion 52*b*.

EMBODIMENT 5

Figure 15A:
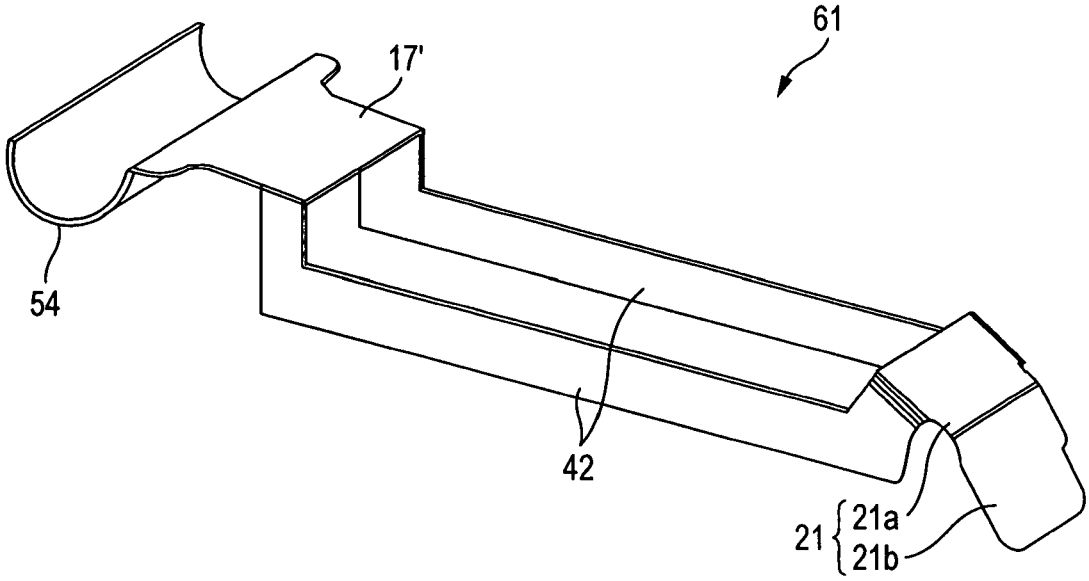
Figure 15B:
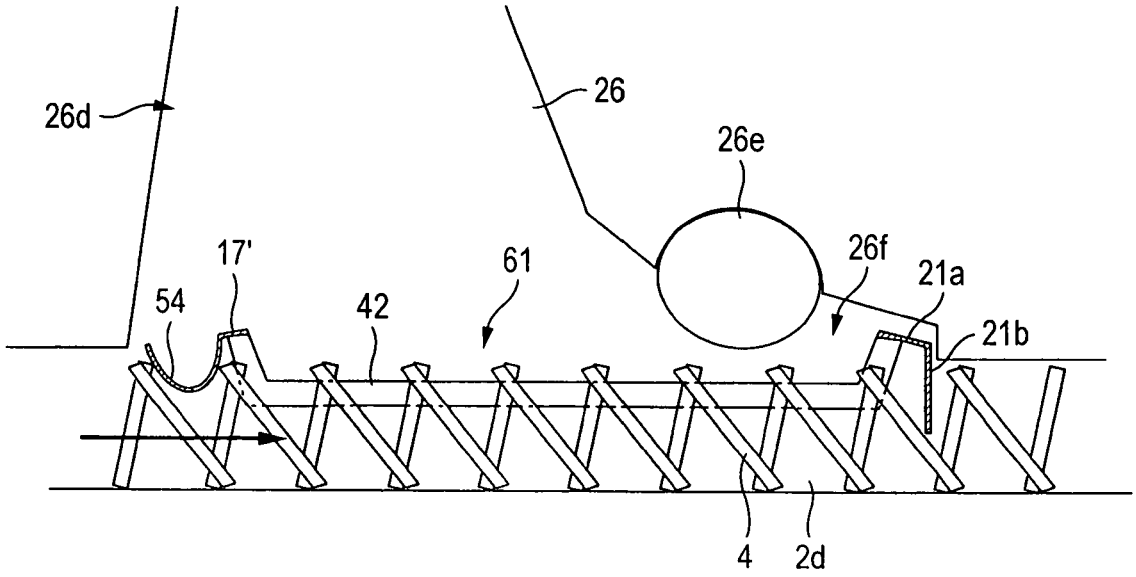

FIG. 15 shows explanatory drawings of an aggregation preventing member of Embodiment 5 of the invention, in which FIG. 15A is an explanatory perspective view of the aggregation preventing member which corresponds to FIG. 9 illustrating Embodiment 1, and FIG. 15B is a sectional view of a main part of the aggregation preventing member which corresponds to FIG. 5 illustrating Embodiment 1.

Next, an image forming apparatus will be described below which includes an aggregation preventing member of Embodiment 5 of the invention. In the description of Embodiment 5, like reference numerals will be imparted to like constituent elements to those of Embodiments 1 to 4, and a detailed description thereof will be omitted here. While Embodiment 5 differs from Embodiments 1 to 4 in the following points, Embodiment 5 is identical in configuration to Embodiments 1 to 4 with respect to the other points.

In FIG. 15, an aggregation preventing member 61 of Embodiment 5 has a plate-like flat plate portion 17', and a developer scrub-off portion 42 and a contact portion 21 which are similar, respectively, to the developer scrub-off portion 42 of the aggregation preventing member 41 and the contact portion 21 of Embodiment 3 are formed on a downstream side of the flat plate portion 17' in the developer transport direction. A semi-arc-like contact portion 54 which is configured similarly to the contact portion 54 of Embodiment 4 is formed on an upstream side the flat plate portion 17'.

FUNCTION OF EMBODIMENT 5

In the image forming apparatus U of Embodiment 5 that is configured as has been described above, being different from Embodiments 1 to 3, an upstream end and a downstream end of the aggregation preventing member 61 in the developer transport direction are both made to constitute free ends, and the aggregation preventing member 61 is held in a so-called floating state by the contact portions 21, 54 at the front and rear ends thereof. In addition, as with the aggregation preventing member 51 of Embodiment 4, since a front end of the contact portion 21 in the developer transport direction is brought into contact with a front end side inner wall surface of a third drop path 26*f*, whereby the movement thereof is restricted, the contact portions 21, 42 which are in contact with the coil auger 4 move vertically as the coil auger 4 rotates. As the contact portions 21, 42 move vertically, the developer scrub-off portion 42 moves vertically, whereby the developer sticking to the inner wall 2*c*1 is scrubbed off.

EMBODIMENT 6

Figure 16:
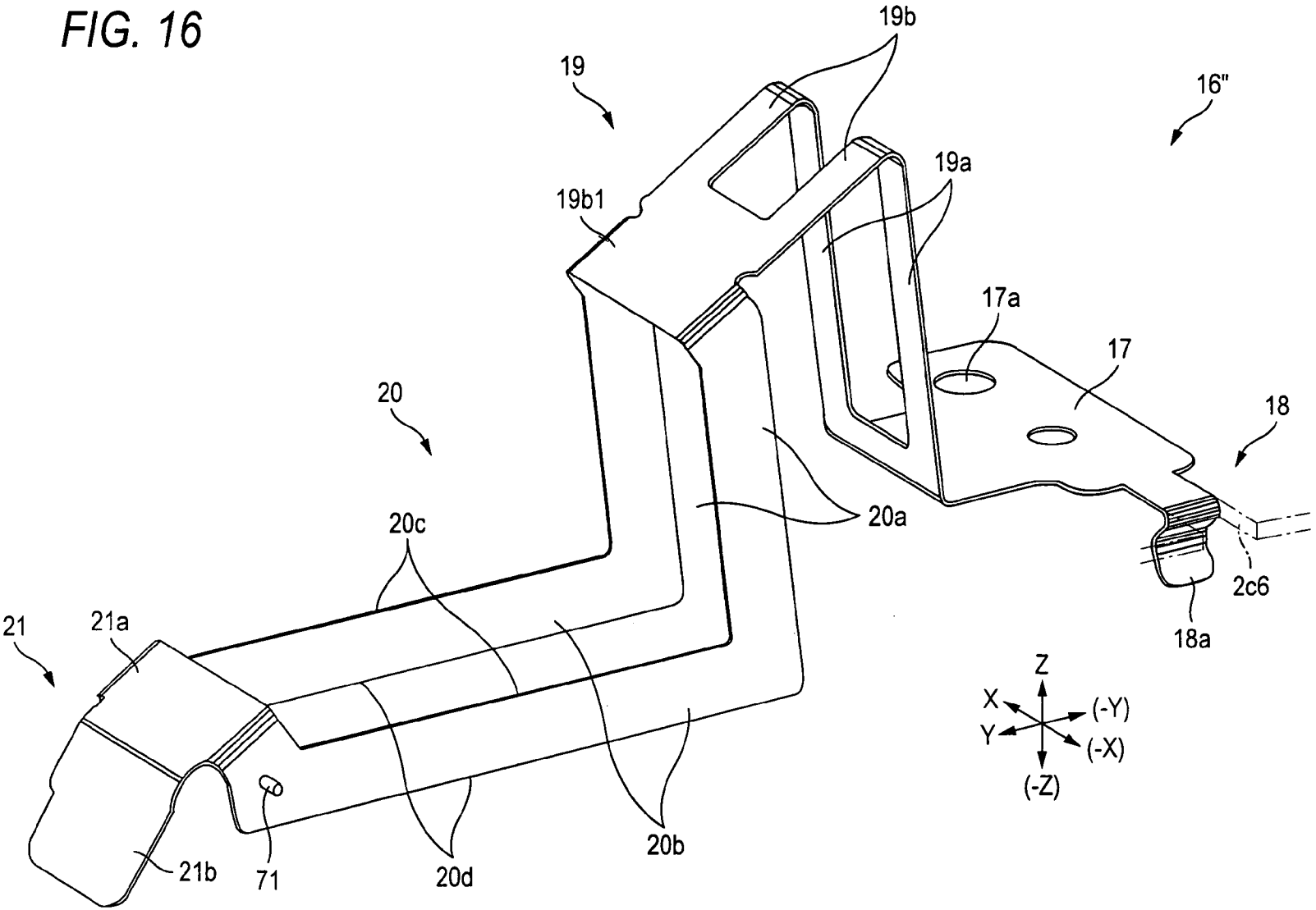
FIG. 16 is an explanatory perspective view which describes an aggregation preventing member of Embodiment 6 of the invention, the perspective view corresponding to FIG. 9 which illustrates Embodiment 1.

FIG. 16 shows explanatory drawings of an aggregation preventing member of Embodiment 6 of the invention, which corresponds to FIG. 9 illustrating Embodiment 1.

Next, an image forming apparatus will be described below which includes an aggregation preventing member of Embodiment 6 of the invention. In the description of Embodiment 6, like reference numerals will be imparted to like constituent elements to those of Embodiment 1, and a detailed description thereof will be omitted here. While Embodiment 6 differs from Embodiment 1 in the following points, Embodiment 6 is identical in configuration to Embodiment 1 with respect to the other points.

In FIG. 16, in an aggregation preventing member 16" of Embodiment 6, a pair of front and rear projections 71, which are an example of a projecting portion, are disposed on the aggregation preventing member distal end portion 21 side of the developer scrub-off portion 20 of the aggregation preventing member 16 of Embodiment 1 in such a manner as to project outwards, that is, towards the inner wall surface 2*c*1 side. Note that only one of the pair of projections 71 is shown in FIG. 16.

FUNCTION OF EMBODIMENT 6

In the image forming apparatus U of Embodiment 6, when the developer scrub-portion of the aggregation preventing member 16" moves along the inner wall surface 2*c*1, the projections 71 and the inner wall surface 2*c*1 are brought into contact with each other. Namely, an interval between the developer scrub-off portion 20 and the inner wall surface 2*c*1 is held to a predetermined interval by virtue of the contact between the projections 71 and the inner wall surface 2*c*1 so that the developer is stuck to the inner wall surface 2*c*1 as a result of the developer scrub-off portion 20 and the inner wall surface 2*c*1 being kept in contact with each other.

MODIFIED EXAMPLES

Thus, while the embodiments of the invention have been described in detail heretofore, the invention is not limited to those embodiments, and hence, the invention can be modified variously without departing from the spirit and scope of the invention which are described under the claims thereof. Modified examples of the invention will be described below under (H01) to (H011).

(H01) In the embodiments, while the photocopier is illustrated as the image forming apparatus, the invention is not limited thereto, and hence, the invention can be applied to a FAX, a printer or multifunction equipment which includes the functions thereof or a plurality of functions. In addition, the invention is not limited to a monochrome image processing system but may be applied to a color image forming apparatus.

(H02) In the embodiments, while the waste developer transporting apparatus for transporting a waste developer is described as the developer transporting apparatus, the invention is not limited thereto but can be applied to an arbitrary developer transporting apparatus which has a drop path through which a developer drops to be transported. Namely, the invention can be applied to a refill developer transporting apparatus for refilling the developing device G with a fresh developer or a developer transporting apparatus for transporting the recovered developer for reuse in the developing device G as when the developer recovered by the cleaner or the like is reused by the developing device G.

(H03) In the embodiments, while the coil spring-like developer transporting member is illustrated as the developer transporting member, the invention is not limited thereto, and hence, the invention can be applied to a developer transporting member made up of a rotational shaft and transfer blades which are fixed to the rotational shaft or a so-called developer transporting apparatus having an auger. As this occurs, the contact portion 21*b* can be configured so as to be in continuous contact with either the rotational shaft or the transport blades. In addition to this, the invention can be applied to a developer transporting apparatus having a crank-like developer transporting member or a paddle-like developer transporting member.

(H04) In the embodiments, in order to avoid the occurrence of an event in which a developer is held between the aggregation preventing member and the inner wall surface 2*c*1 to be rubbed and kneaded into aggregates, while a gap is desirably provided between the aggregation preventing member and the inner wall surface 2*c*1, it is possible to omit such a gap.

(H05) In the embodiments, while the developer scrub-off portion is desirably provided below the developer drop port 26*a* in the perpendicular direction, the developer scrub-off portion can be disposed in a position which deviates from the relevant position.

(H06) In Embodiment 4, while the developer scrub-off portion 52 is provided only on the outside of the upper portion of the downstream side in the rotational direction of the coil auger 4 where the sticking of developer is easy to occur, as with Embodiments 1 to 3, a configuration can be adopted in which the developer sticking to both the inner wall surfaces 2*c*1 can be scrubbed off. Namely, the aggregation preventing member 51 of Embodiment 4 can be formed into a box-like configuration.

(H07) In Embodiments 1, 2, while the plate spring portion 19 is configured so as to generate vibrations, the invention is not limited to this configuration. For example, in place of the plate spring portion, a configuration can be adopted in which the developer scrub-off portion 20 is supported on the fixed portion 17 in such a manner as to rotate about a hinge shaft, so that the developer scrub-off portion 20 moves vertically about the hinge shaft as the contact portion 21*b* moves vertically.

(H08) In the embodiments, since discharged developer contains therein carriers, the fluidity thereof is better than that of waste developer, and because of this, in the first drop path 11*a* for discharged developer and the drop paths 26*d*, 26*f* for waste developer, no aggregation preventing member is provided in the first drop path 11*a* and only the aggregation preventing member which corresponds to the second drop path 26*d* is provided. However, the invention is not limited to this configuration, and hence, aggregation preventing members can be provided so as to correspond to the other drop paths 11*a*, 26*f*.

(H09) In Embodiments 4, 5, a fastening member such as a string or rope can be used so as to prevent the aggregation preventing members 51, 61 from being transported to the downstream side along the developer transport direction.

(H010) In the embodiments, while the generation of noise and abnormal noise and deterioration of the aggregation preventing member which result from the contact between the contact portion 21 of the aggregation preventing member and the coil auger 4 constitute problems, in order to decrease the degrees thereof, a coating of a soft material having high noise insulation properties can be formed on the surface of either the contact portion or the coil auger or the surfaces of both, or such a coating can be formed from a material having wear-resistant properties.

(H011) In the embodiments, while the perpendicular heights of the connecting portions of the developer transporting path 2*d* with the first drop path 11*a*, the second drop path 26*d* and the third drop path 26*f* are lowered sequentially in that order so that the developer transporting path 2*d* is properly inclined to produce a smooth flow of developer along the developer transport direction, the invention is not limited to the configuration but can be applied to a developer transporting path 2*d* having an arbitrary path configuration.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developer transporting apparatus comprising:

a drop path through which a developer drops;

a developer transporting path that is connected to the drop path, and through which a developer flowing thereinto from the drop path is transported;

a developer transporting member that is disposed within the developer transporting path, and that rotates to transport the developer residing within the developer transporting path; and an aggregation preventing member including:

a contact portion that is in contact with the developer transporting member, and that moves in conjunction with the rotation of the developer transporting member; and a developer scrub-off portion that is disposed between an inner wall surface of the developer transporting path and the developer transporting member, and that moves along the inner wall surface in conjunction with the movement of the contact portion, at least part of the aggregation preventing member being disposed at a connecting portion between the drop path and the developer transporting path to prevent the aggregation of the developer to the inner wall surface.

2. The developer transporting apparatus as claimed in claim 1, wherein the developer scrub-off portion comprises strip-like scrub-off portions facing each other across the developer transporting member, and is disposed in such a manner as to enter the developer transporting member and the inner wall surface of the developer transporting path.

3. The developer transporting apparatus as claimed in claim 2, wherein the developer scrub-off portion has a projecting portion projecting towards the inner wall surface.

4. The developer transporting apparatus as claimed in claim 1, wherein the aggregation preventing member comprises:

a fixed portion that fixes the aggregation preventing member to the developer transporting path; and a plate spring portion that extends upwards from the fixed portion, that is elastically deformable, and that is able to connect the fixed portion and the developer scrub-off portion.

5. The developer transporting apparatus as claimed in claim 3, wherein the aggregation preventing member comprises:

a fixed portion that fixes the aggregation preventing member to the-developer transporting path; and a plate spring portion that extends upwards from the fixed portion, that is elastically deformable, and that is able to connect the fixed portion and the developer scrub-off portion.

6. The developer transporting apparatus as claimed in claim 4, wherein the drop path has a divergent shape having width becoming larger as the divergent shape extends downwards from a developer drop port from which the developer flows into the drop path, and the plate spring portion is disposed in a position which is deviated from a point below the developer drop port in a direction along with the drop path.

7. The developer transporting apparatus as claimed in claim 1, wherein the developer transporting path has a convergent shape having width becoming smaller as the convergent shape extends towards a bottom portion side thereof in accordance with an external shape of the developer transporting member, and the contact portion has narrower shape than the width of the developer transporting path in a moving range of the contact member.

8. The developer transporting apparatus as claimed in claim 6, wherein the developer transporting path has a convergent shape having width becoming smaller as the convergent shape extends towards a bottom portion side thereof in accordance with an external shape of the developer transporting member, and the contact portion has narrower shape than the width of the developer transporting path in a moving range of the contact member.

9. An image forming apparatus comprising:

a developer recovery unit that recovers a developer that has not been transferred on to a medium on which an image is to be recorded by an image forming operation;

a drop path through which the recovered developer so recovered drops;

a developer transporting path that is connected to the drop path, and through which the recovered developer flowing thereinto from the drop path is transported;

a developer transporting member that is disposed within the developer transporting path, and that rotates to transport the recovered developer within the developer transporting path; and an aggregation preventing member including:

a contact portion that is in contact with the developer transporting member, and that moves in conjunction with the rotation of the developer transporting member; and a developer scrub-off portion that is disposed between an inner wall surface of the developer transporting path and the developer transporting member, and that is linked with the contact portion in such a manner as to move along the inner wall surface in conjunction with the movement of the contact portion, at least part of the aggregation preventing member being disposed at a connecting portion between the drop path and the developer transporting path to prevent the aggregation of the developer to the inner wall surface.

10. An image forming method comprising:

recovering a developer that has not been transferred on to a medium on which an image is to be recorded by an image forming operation through a drop path so as the recovered developer drops;

transporting the recovered developer through a developer transporting path so as the recovered developer flows into the developer transporting path from the drop path;

the developer transporting path having a developer transporting member that rotates to transport the recovered developer within the developer transporting path;

the developer transporting path having a developer scrub-off portion that is disposed between an inner wall surface of the developer transporting path and the developer transporting member, and that is linked with the contact portion in such a manner as to move along the inner wall surface in conjunction with the movement of the contact portion, at least part of the aggregation preventing member being disposed at a connecting portion between the drop path and the developer transporting path to prevent the aggregation of the developer to the inner wall surface.

* * * * *